US008091563B2

(12) United States Patent
Shepherd et al.

(10) Patent No.: US 8,091,563 B2
(45) Date of Patent: Jan. 10, 2012

(54) HAIR STYLING APPARATUS HAVING CLOTH-COVERED HEATING MEMBER

(75) Inventors: Karen Lee Shepherd, Hampshire (GB); John H. Wilcox, Newport, RI (US); Chun-Man Leung, Sai Kung (HK)

(73) Assignee: Rovcal, Inc., Madison, WI (US)

( * ) Notice: Subject to any disclaimer, the term of this patent is extended or adjusted under 35 U.S.C. 154(b) by 874 days.

(21) Appl. No.: 11/460,487

(22) Filed: Jul. 27, 2006

(65) Prior Publication Data

US 2008/0041408 A1 Feb. 21, 2008

(51) Int. Cl.
*A45D 2/40* (2006.01)
*A45D 1/00* (2006.01)

(52) U.S. Cl. ..... 132/224; 132/225

(58) Field of Classification Search ..... 132/224–229; 219/225; 15/231, 232; 451/523–525; 38/94–97
See application file for complete search history.

(56) References Cited

U.S. PATENT DOCUMENTS

| | | | | |
|---|---|---|---|---|
| 3,537,123 | A * | 11/1970 | Leland | 15/244.2 |
| 4,477,716 | A | 10/1984 | Thaler et al. | |
| 4,581,519 | A | 4/1986 | Thaler et al. | |
| 5,385,765 | A * | 1/1995 | Springer et al. | 428/36.1 |
| 5,773,802 | A * | 6/1998 | Graves | 219/759 |
| 5,857,470 | A | 1/1999 | Schmidt et al. | |
| 6,173,718 | B1 | 1/2001 | Okumoto et al. | |
| 6,199,558 | B1 | 3/2001 | Schmidt et al. | |
| 6,235,388 | B1 * | 5/2001 | Yamamoto et al. | 428/364 |
| 6,278,086 | B1 | 8/2001 | Janouch et al. | |
| 6,325,072 | B1 | 12/2001 | Smetana | |
| 6,622,735 | B2 | 9/2003 | Hirata et al. | |
| 2002/0036000 | A1 | 3/2002 | Hirata et al. | |
| 2002/0092196 | A1 | 7/2002 | Tobin et al. | |

FOREIGN PATENT DOCUMENTS

| | | | |
|---|---|---|---|
| EP | 1169936 | B1 | 9/2004 |
| GB | 2167953 | A * | 6/1986 |
| JP | 2003020515 | A * | 1/2003 |

OTHER PUBLICATIONS

Author Unknown, Teflon Fibers, Stern and Stern Fabric Weaving Specialists, http://web.archive.org/web/20050204150048/http://sternandstern.com/teflon.asp, printed Oct. 26, 2006, 2 pages, Stern and Stern, Inc., US.

Author Unknown, Glossary, Stern and Stern Fabric Weaving Specialists, http://www.sternandstern.com/glossary.asp, printed Jul. 5, 2006. 16 pages, Stern and Stern, Inc., US.

* cited by examiner

*Primary Examiner* — Robyn Doan
(74) *Attorney, Agent, or Firm* — Armstrong Teasdale LLP

(57) ABSTRACT

A hair styling apparatus has a heating member and a cloth covering at least a portion of the heating member to define a hair-facing surface onto which hair is placed in contact therewith for heating. The cloth is constructed at least in part of a monofilament of a fluorinated polyethylene. In another embodiment, the cloth is responsive to heating of the heating member to shrink relative to the heating member in at least one of a longitudinal direction and a transverse direction of the cloth. In yet another embodiment, the cloth is unbonded to the heating member and held in tension over the portion of the heating member that defines the hair-facing surface.

28 Claims, 21 Drawing Sheets

HAIR STYLING APPARATUS HAVING CLOTH-COVERED HEATING MEMBER

FIELD OF INVENTION

The present invention relates generally to hair styling apparatus, and more particularly to hair styling apparatus having one or more heated surfaces used to style (e.g., to straighten, curl, wave, etc.) hair.

BACKGROUND

Many different types of hair styling apparatus are available for use in styling hair, such as straightening, curling, waving or otherwise achieving a desired look. Common among such hair styling apparatus is the ability to apply heat to the hair, and in particular to provide one or more heated surfaces against which the hair to be styled is contacted during styling. For example, styling apparatus such as curling irons typically have a single heating member, such as in the form of a cylindrical or semi-cylindrical shaped heating member, that provides a heated surface for contacting the hair to be styled. A pivotable clamp member is often provided on the curling iron to hold the hair being styled against the heated surface during styling. Heat applied to the hair by the heating member while the hair is wrapped around the heated surface of the heating member imparts a curl to the hair.

Hair straighteners (which are also sometimes referred to as heated tongs or flat irons) often have a pair of arms that are moveable relative to one another between a closed position in which at least portions of the arms are in close proximity to one another to hold hair therebetween and an open position in which the arms are spaced from one other such that the arms are generally inoperative to hold hair. A heating member is provided on at least one of the arms, and more typically on both of the arms, to provided opposed heated surfaces between which the hair being styled is disposed when the arms in their closed position. The hair is straightened as a result of the heat and pressure applied by the heating members.

One drawback with the use of such conventional hair styling apparatus is the risk of damaging the hair upon exposure to the heat and/or pressure applied to the hair during styling. For example, the one or more heating members of common hair styling apparatus are metal and/or ceramic and may be heated to a relatively high temperature (e.g., in the range of about 150 to about 250 degrees Celsius). Direct contact of the hair against the heated surface of the heating member can result in relatively rapid heating of hair contacting the heating member, with this rapid heating resulting in hair damage such as scorching.

Further, metal and ceramic materials from which the heating members are made are relatively hard and unyielding when contacted by the hair being styled. In particular, for apparatus in which the hair being styled is clamped between such heating members (e.g., as is the case for conventional hair straighteners), hairs can be crushed or suffer other physical damage such as sharp bends, kinks, indentations in the hair shaft, split ends, etc. as a result of hair to heating member contact and/or hair to hair contact between the heating plates. The resultant damage to the hair shaft weakens the hair, making the site more susceptible to other types of damage such as loss of cuticle scales.

There is a need, therefore, for hair styling apparatus that allow hair to be styled while reducing the damage inflicted on the hair by the one or more heating members of a hair styling apparatus.

SUMMARY

In one embodiment, a hair styling apparatus generally comprises a heating member assembly having a hair-facing surface over which hair is placed for heating. The heating member assembly generally comprises a heating member for applying heat to the hair, and a cloth constructed at least in part of a monofilament of a fluorinated polyethylene and covering at least a portion of the heating member to define the hair-facing surface of the heating member assembly.

In another embodiment, a hair styling apparatus generally comprises a heating member for applying heat to hair. At least a portion of the heating member defines a hair-facing surface over which hair is placed for heating. A cloth covers at least the portion of the heating member that defines the hair-facing surface. The cloth has a longitudinal direction and a transverse direction and is responsive to heating of the heating member to shrink relative to said heating member in at least one of the longitudinal direction and the transverse direction of the cloth.

In still another embodiment, a hair styling apparatus generally comprises a heating member for applying heat to hair. At least a portion of the heating member defines a hair-facing surface over which hair is placed for heating. A cloth covers at least the portion of the heating member that defines the hair-facing surface. The cloth is unbonded to the heating member and held in tension over the portion of the heating member that defines the hair-facing surface.

A hair straightener according to one embodiment generally comprises a heating member assembly having a hair-facing surface onto which hair is placed in contact therewith for heating. The heating member assembly comprises a heating member for applying heat to the hair, and a cloth covering at least a portion of the heating member to define the hair-facing surface of the heating member assembly. The hair straightener damages less than or equal to about 40 percent of hair according to a Hair Damage Assessment Test at a temperature of at least 150 degrees Celsius.

BRIEF DESCRIPTION OF DRAWINGS

Corresponding reference characters indicate corresponding parts throughout the drawings.

DETAILED DESCRIPTION

Figure 1:
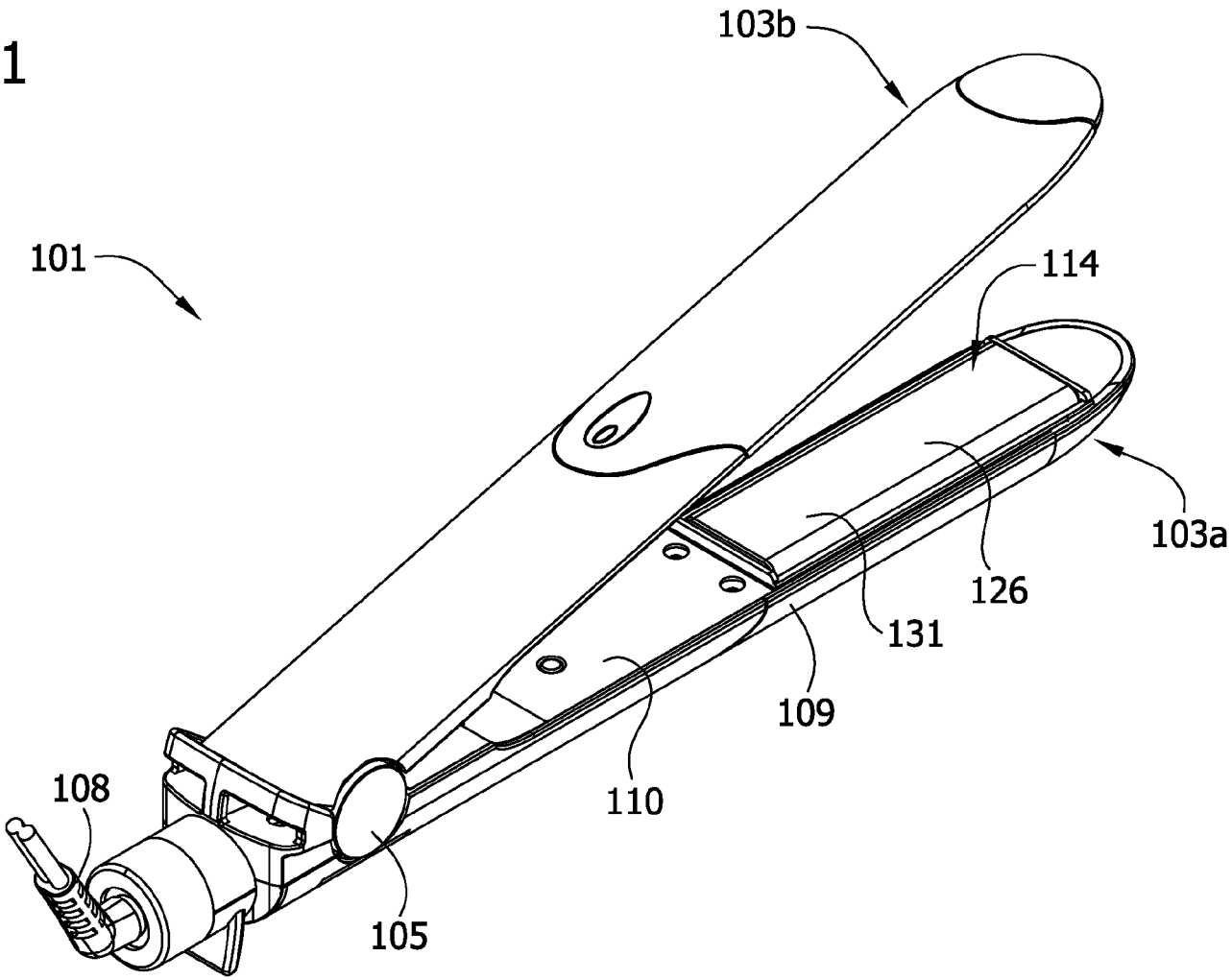
FIG. 1 is a perspective of a hair styling apparatus according to one embodiment of the present invention in the form of a hair straightener having opposed arms in an open position of the straightener.
Figure 2:
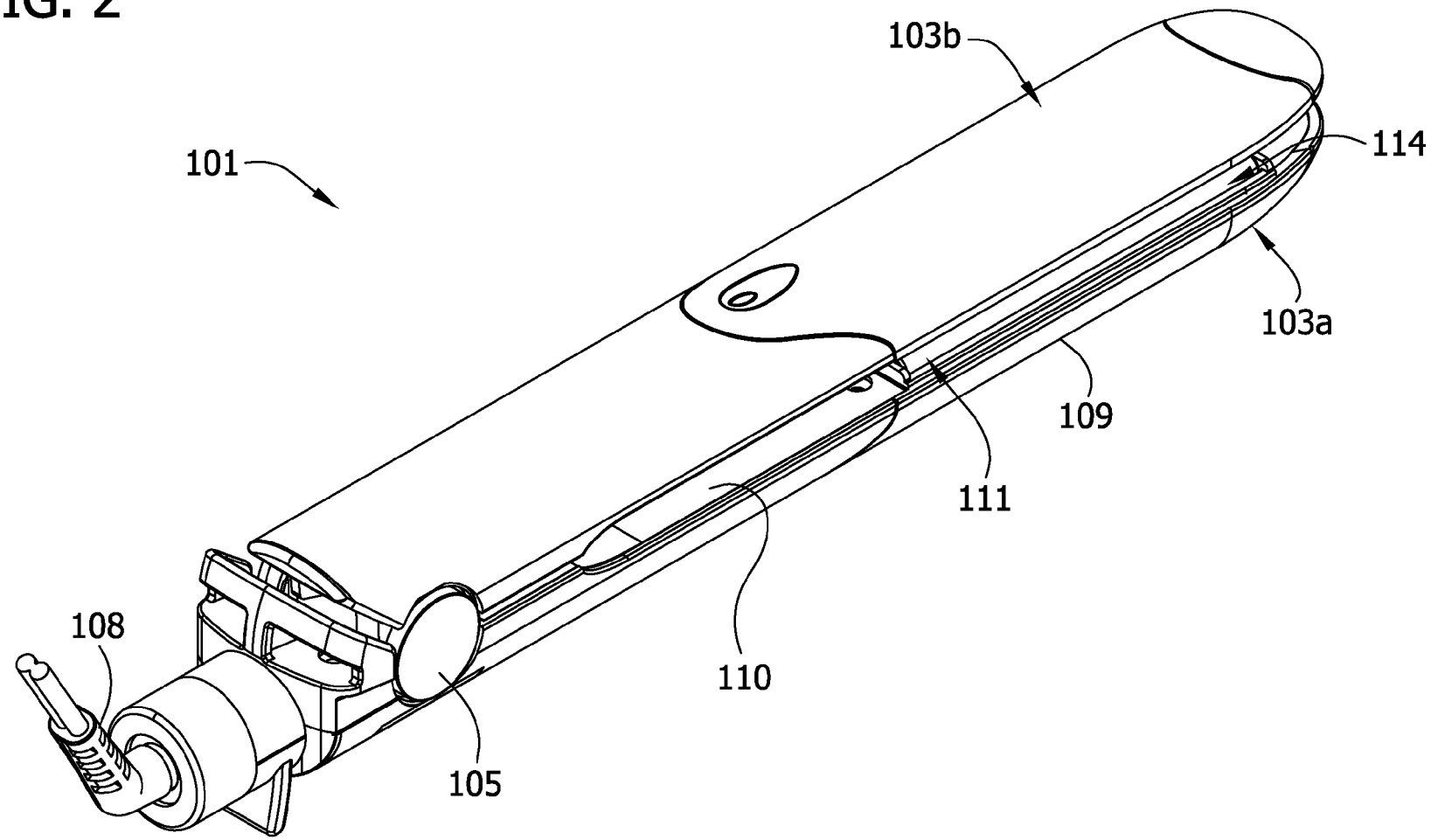
FIG. 2 is perspective of the hair straightener with the arms in a closed position of the straightener.
Figure 3:
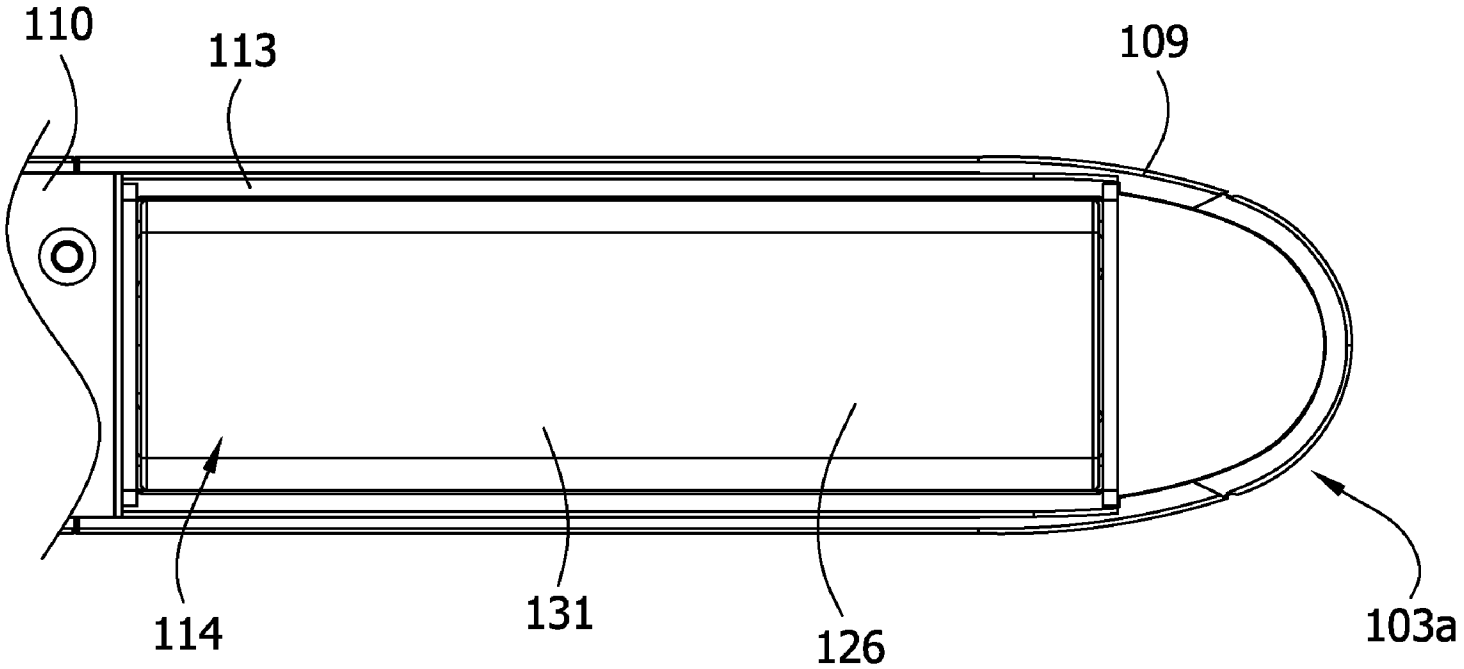
FIG. 3 is a fragmented plan view of one arm of the hair straightener of FIG. 1.

Referring now to the drawings and in particular to FIGS. 1 and 2, one embodiment of a hair styling apparatus according to the present invention is generally designated 101 and is illustrated in the form of a hair straightener (also sometimes referred to as a flat iron) used for straightening hair.

Figure 4:
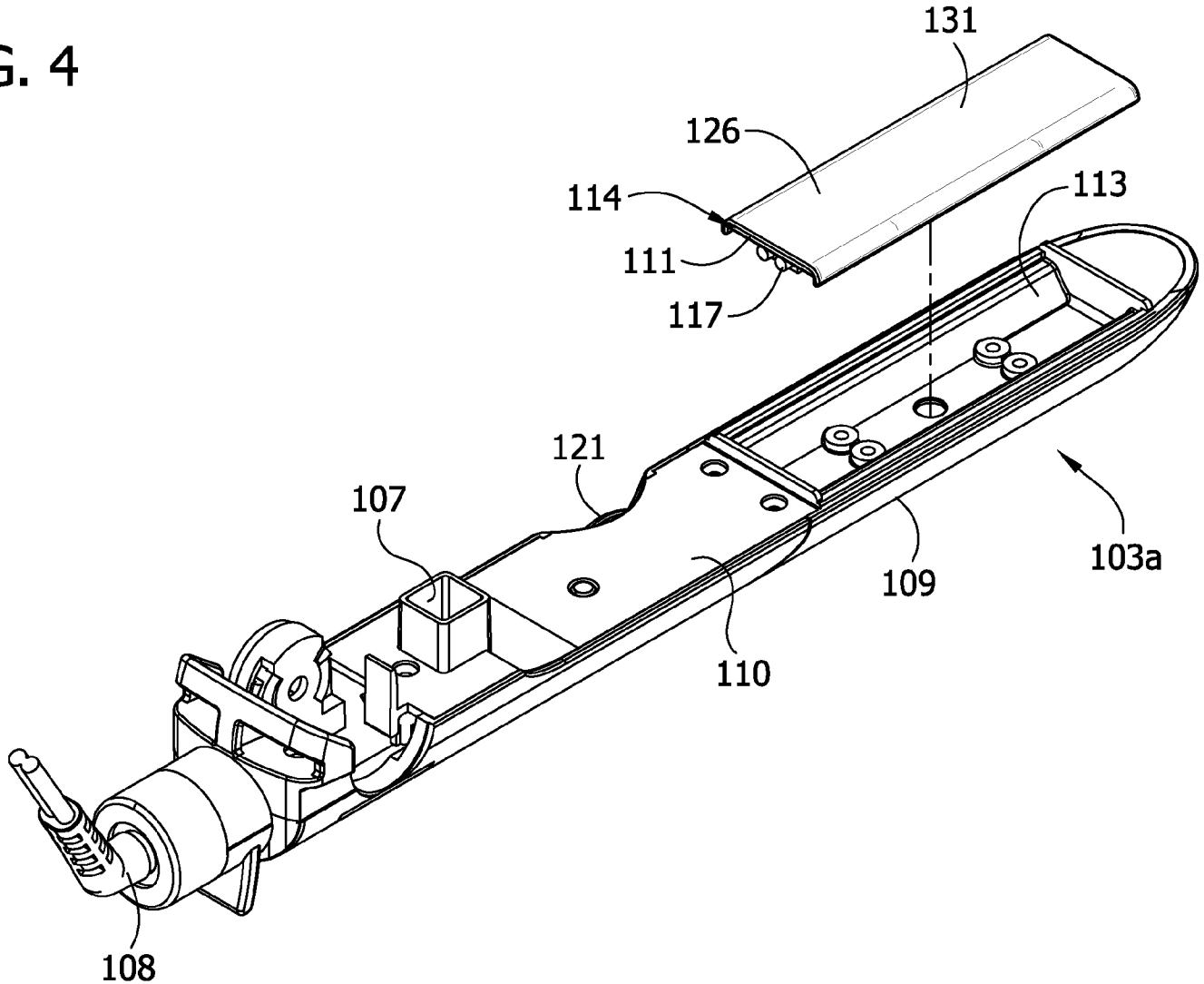
FIG. 4 is a perspective of one arm of the hair straightener of FIG. 1, with a heating member assembly shown exploded from the arm.

The hair straightener 101 has a pair of arms, generally indicated at 103*a* and 103*b*, held in assembly with each other by a suitable pivot connection 105 disposed toward one end of the arms. The arms 103*a*, 103*b* are thus moveable relative to one another on the pivot axis of pivot connection 105 between an open position (FIG. 1) of the hair straightener 101 and a closed position (FIG. 2) thereof. A biasing member (not shown) in the form of a compression spring is suitably positioned between the arms 103*a*, 103*b* adjacent the pivot connection 105, and in particular the spring is seated within opposed spring seats 106 (one of which is illustrated in FIG. 4) formed on each arm to bias the arms toward the open position of the straightener 101.

With particular reference to the lower arm 103*a* of the straightener 101 as illustrated in FIGS. 1-4, the lower arm comprises an outer shell or housing member 109 that generally defines an interior channel in which various components of the straightener are located. For example, longitudinally adjacent the spring seat 106 is an access panel 110 that together with the housing member 109 of the lower arm 103*a* encloses a suitable control system (not shown) for controlling operation of the hair straightener (such as power on/off and/or heat output control). The control system is electrically connected to a suitable power source (not shown) via an electrical cord 108 that connects to the hair straightener 101 rearward of the pivot connection 105, and by suitable internal wiring (not shown) between the cord and the control system. A suitable switch 121, and in particular an adjustable setting switch, is accessible exterior of the lower arm 103*a* and is useable by the user to operate the control system of the hair straightener 101.

While in the illustrated embodiment the switch 121 and control system are located on the lower arm 103*a* of the hair straightener 101, it is understood that the switch and control system may instead be located on the upper arm 103*b* of the straightener. It is also contemplated that separate switches may be provided, one for power on/off and another for controlling the heat output, or that a single power on/off switch may be provided without the ability to control the heat output, and remain within the scope of this invention.

A cradle insert 113 seats within the interior space of the housing member 109 and forms a cradle in which a heating member assembly (FIG. 4), generally indicated at 114, is seated and secured. The heating member assembly 114 comprises a heating member 111, such as in the form of a generally rectangular plate for the hair straightener 101 of the illustrated embodiment, a heating unit housing 115 (FIG. 6) and a heating unit 117 (also illustrated in FIG. 6) disposed within the housing and electrically connected to the control system via suitable wiring (not shown). The illustrated heating unit housing 115 is suitably formed integrally with the heating member 111 on an inner surface 127 (FIG. 6) thereof. The term "inner surface" is used herein to refer to the surface 127 of the heating member 111 that faces away from the hair being styled between the arms 103*a*, 103*b* in the closed position of the hair straightener 101, e.g., facing inward of the interior channel of the arm housing member 109. It is contemplated that the housing 115 for the heating unit 117 may instead be formed separate from the heating member 111 and may or may not be secured to the heating member without departing from the scope of this invention.

The heating unit 117 suitably comprises one or more heaters, such as electrical resistance heaters, positioned in contact with or in sufficiently close proximity to the inner surface 127 of the heating member 111 to heat the heating member during use of the hair straightener 101. For example, in one suitable embodiment the heating unit 117 is operable to heat the heating member 111 to a temperature of at least about 100 degrees Celsius, and may heat the heating member up to a temperature of about 250 degrees Celsius. In another embodiment the heating unit 17 is operable to heat the heating member to a temperature in the range of about 180 to about 230 degrees Celsius. It is understood that other suitable heating units or heating methods may be used to heat the heating member 111 without departing from the scope of this invention.

The heating member 111 of the illustrated embodiment is generally rectangular and sized to seat at least partially within the cradle insert 113. The heating member 111 has inner surface 127, and an outer, or hair-facing surface 125 that faces outward away from the interior channel of the arm housing 109, i.e., toward the hair that is being styled in contact with the heating member assembly 114 during use of the hair straightener 101. The heating member 111 may be constructed of any suitable material, such as, without limitation, metal, ceramic materials or combinations thereof as is known in the art.

A second heating member assembly (not shown) is carried by the upper arm 103*b* of the hair straightener 101 and is constructed substantially similar to the heating member assembly 114 carried by the lower arm 103*a*. This second heating member assembly is electrically connected to the control system by suitable wiring (not showing). The heating member assemblies 114 of the lower and upper arms 103*a*, 103*b* are sufficiently located longitudinally on the arms so that in the closed position of the hair straightener 101 the heating member assemblies are in generally opposed relationship with each other to style hair disposed between the heating member assemblies. In particular, each of the heating member assemblies 114 has an outer, hair-facing surface 127 that broadly defines the hair facing surface of the respective the lower and upper arms 103*a*, 103*b* of the hair straightener 101. In the open position of the hair straightener 101, the hair-facing surfaces 127 of the heating member assemblies 114 are spaced apart from one another such that the arms 103*a*, 103*b* are generally inoperative to hold hair therebetween.

Figure 6:
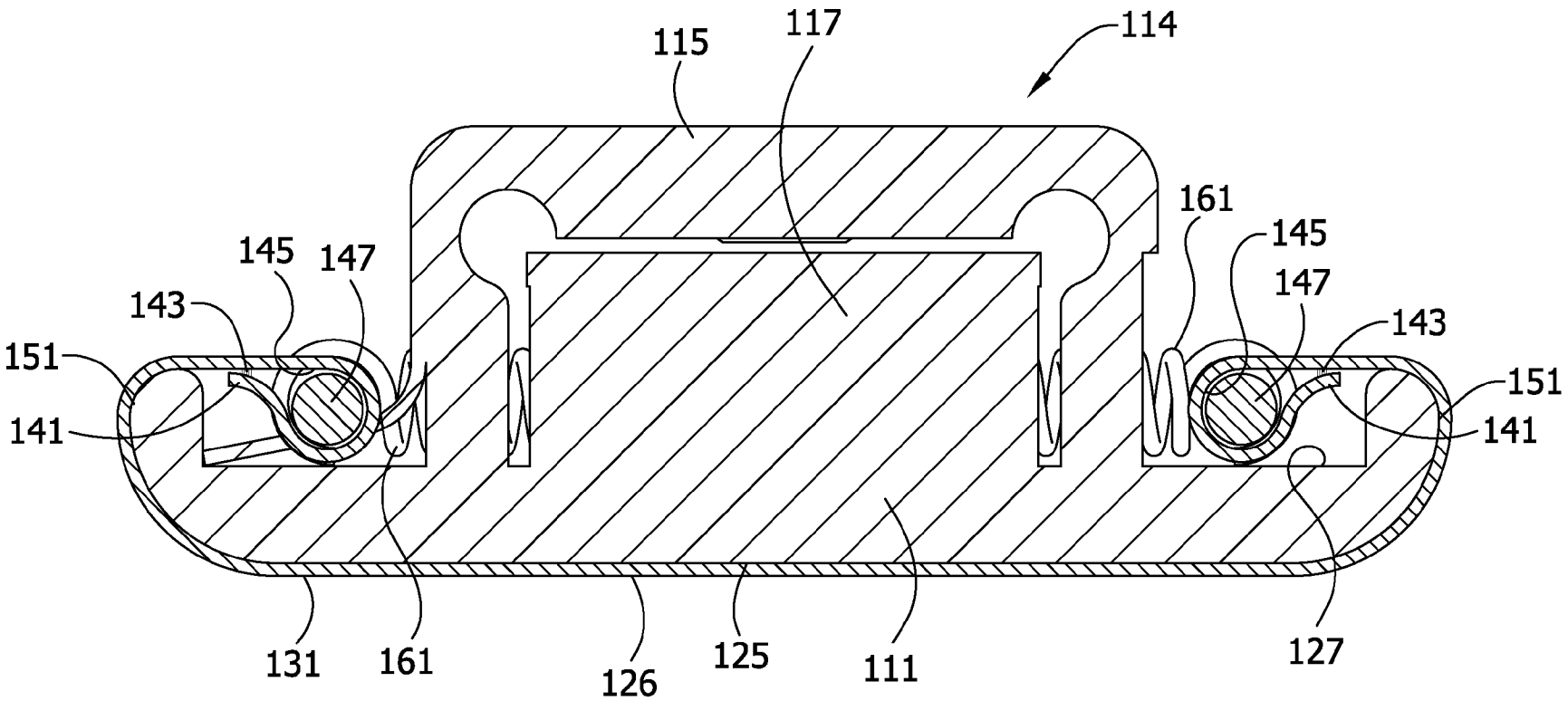
FIG. 6 is a section view of the heating member assembly taken in a plane including the line 6-6 of FIG. 5.

With particular reference to FIG. 6, at least a portion of the hair-facing surface 125 of the heating member 111 of the heating member assembly 114, and more suitably the entire hair-facing surface of the heating member, is covered by a cloth 131 such that the cloth defines the outer, hair-facing surface 127 of the heating member assembly (and hence broadly the hair-facing surface of the lower arm 103*a*). The cloth 131 suitably prevents direct contact between the hair being styled and the heated hair-facing surface 125 of the heating member 111. However, the cloth 131 is suitably constructed to be sufficiently porous (e.g., gas permeable) to permit heated air within pores, voids and/or pockets to reach the cloth. The cloth 131 must therefore be capable of withstanding the relatively high temperatures of the heating member during use, such as in the range of about 150 to about 250 degrees Celsius.

In one suitable embodiment, the cloth 131 is constructed of a material that is suitably less thermally conductive than the material from which the heating member 111 is constructed so that the cloth, upon heating by the heating member, presents a surface temperature at the hair-facing surface 127 of the heating member assembly 114 that is less than the temperature of the hair-facing surface 125 of the heating member. For example, in one embodiment the temperature of the cloth 131, i.e., the hair-facing surface 127 of the heating member assembly 114, may be at least 5 degrees Celsius less than the temperature of the hair-facing surface 125 of the heating member 111, and more suitably it may be about 10 or more degrees Celsius less than the temperature of the hair-facing surface of the heating member. It is understood, however, that the temperature of the hair-facing surface 127 of the heating member assembly 114 may be substantially equal to that of the hair-facing surface 125 of the heating member 111 and remain within the scope of this invention.

In another suitable embodiment, the cloth 131 may also be capable of shrinking in at least a transverse direction of the cloth upon being heated by the heating member 111, without substantial risk of tearing or degradation of the cloth. For example, in one embodiment the cloth 131 may suitably be capable of shrinking in at least the transverse direction of the cloth in the range of about one percent to about ten percent, more suitably in the range of about one percent to about eight percent, still more suitably in the range of about one percent to about five percent, and even more suitably in the range of about one percent to about three percent upon heating by the heating member to a temperature of at least about 150 degrees Celsius. Depending on the particular design of the hair styling apparatus 101 and the material and construction of the cloth 131, it may be desirable to pre-shrink the cloth (e.g., by heating it in boiling water or by another suitable technique) before assembly with the heating member 111 to reduce the amount of heat induced shrinkage that occurs upon heating of the heating member.

The cloth 131 is held in assembly with the heating member 111 without being bonded to the heating member. This is particularly advantageous where the cloth 131 is constructed of a material that is difficult and/or more costly to bond to the heating member 111. It is understood however that the cloth 131 may be bonded to the heating member 111 without departing from the scope of this invention. The cloth 131 of the illustrated embodiment is generally rectangular (before being wrapped about the heating member 111) and is held taut over the hair-facing surface 125 of the heating member 111 to inhibit bunching, wrinkling or other substantial movement of the cloth relative to the heating member as hair is pulled through the hair straightener during use.

As illustrated in FIG. 6, the cloth 131 particularly extends transversely outward over the hair-facing surface 125 of the heating member 111, around the side edges 151 of the heating member and then transversely inward over a portion of the inner surface 127 of the heating member. Wrapping the cloth 131 around the curved side edges 151 of the heating member 111 in this manner inhibits (e.g., via friction of the cloth against the side edges of the heating member) the cloth against working itself loose from the heating member, thereby inhibiting wrinkling, bunching or other movement of the cloth on the heating member.

Figure 5:
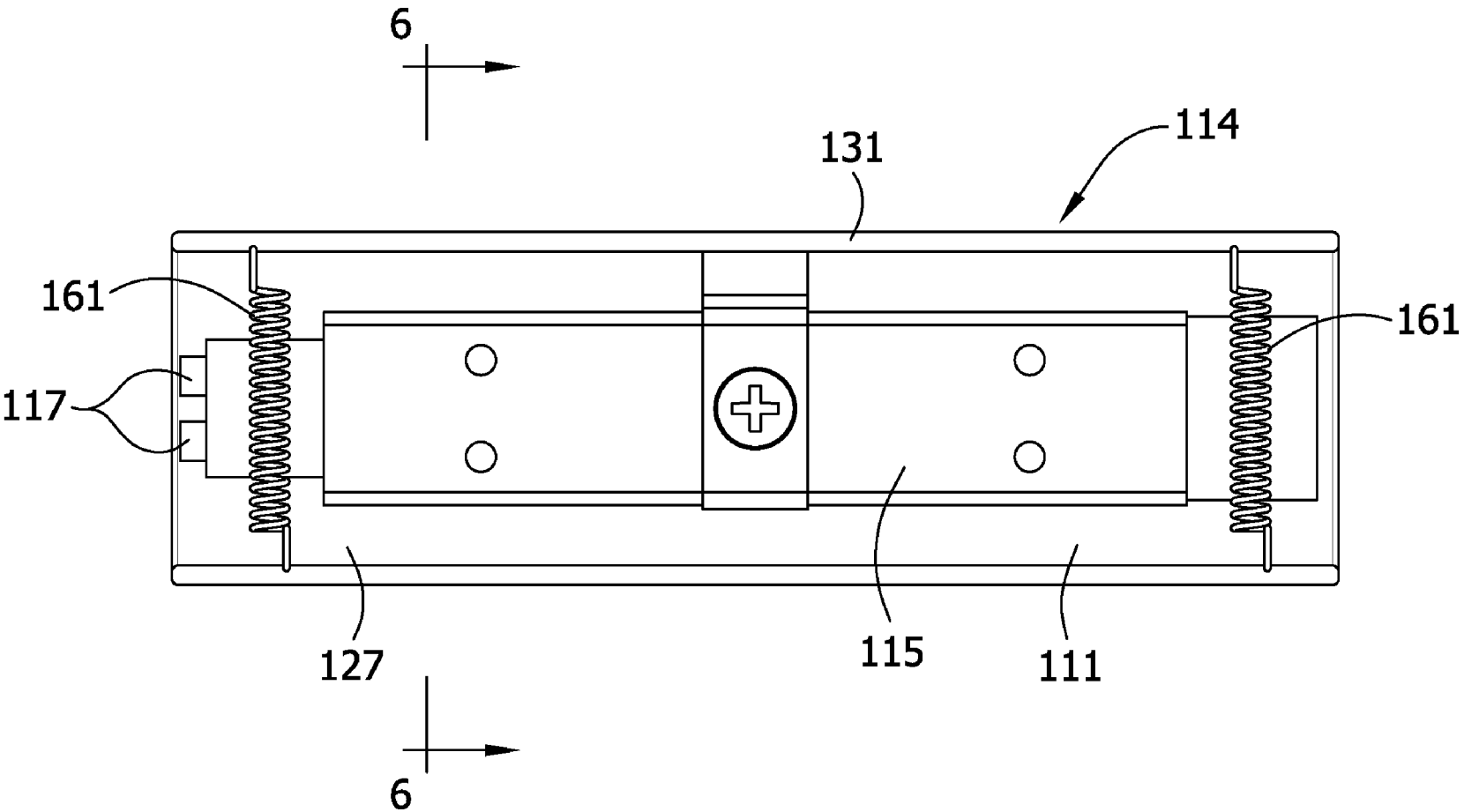
FIG. 5 is a bottom plan view of the heating member assembly.

To further facilitate holding the cloth 131 taut and in assembly with the heating member 111, a pair of connectors 161 extends transversely between and interconnects the transverse side margins 141 of the cloth. In the embodiment illustrated in FIGS. 5-7, the cloth 131 is folded back on itself along each of the transverse side margins 141 of the cloth, and stitched along longitudinally extending seams 143 to form respective pockets 145 extending longitudinally along the transverse side margins of the cloth 131. A pin or rod 147 (e.g., a steel rod) is inserted into each of the pockets 145 to act as anchors for the connectors 161.

Figure 7:
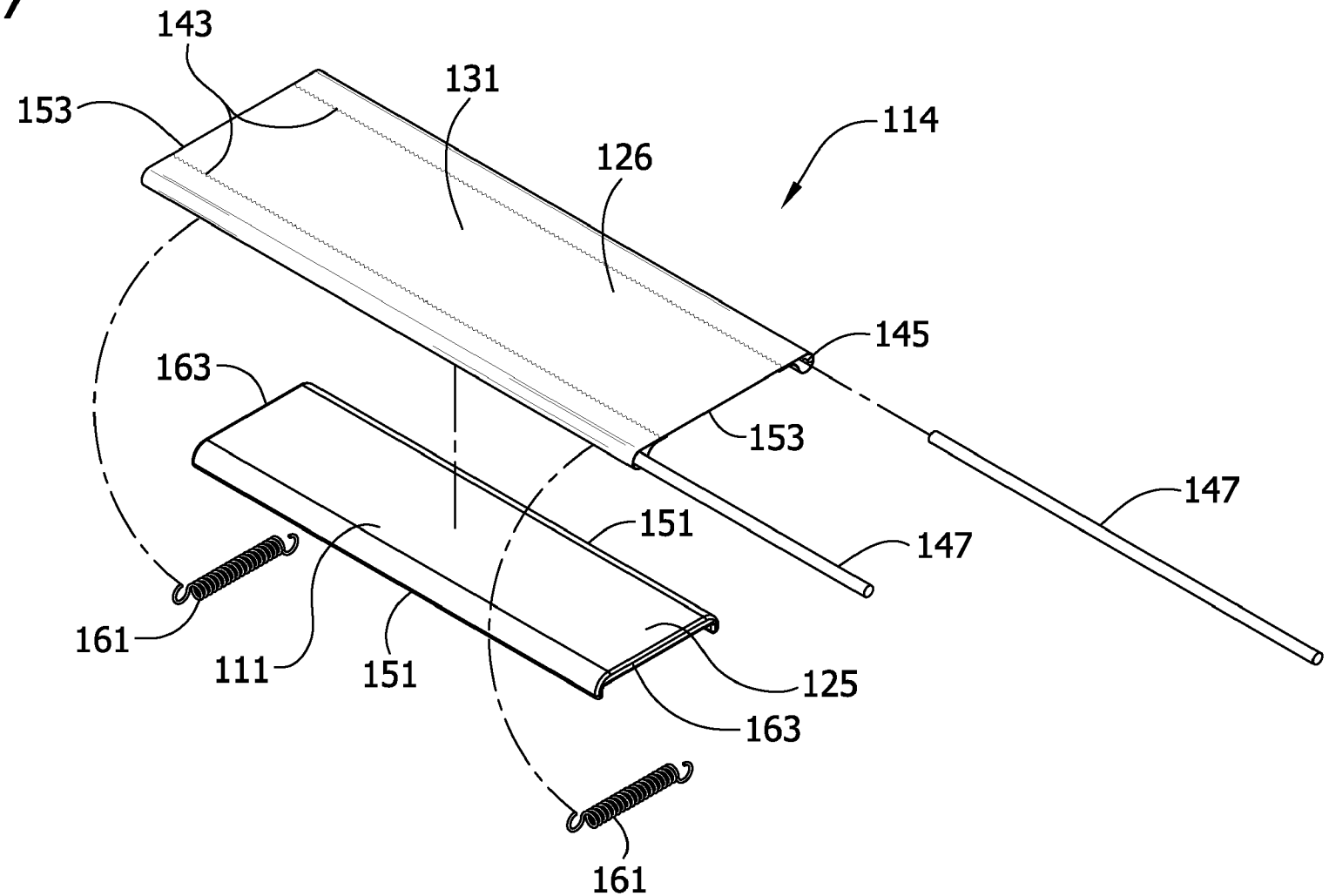
FIG. 7 is an exploded view of a portion of the heating member assembly.
Figure 8:
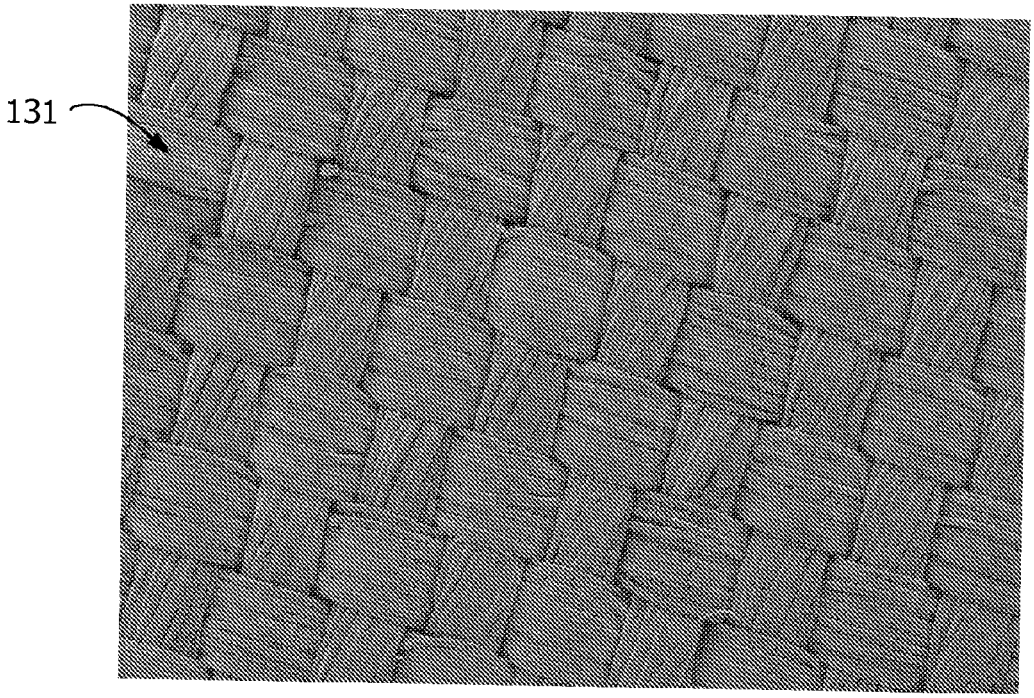
FIGS. 8-15 are scanning electron micrographs of a cloth covering of the heating member assembly, with FIGS. 10-15 including one or more human hairs shown on the cloth covering.
Figure 9:
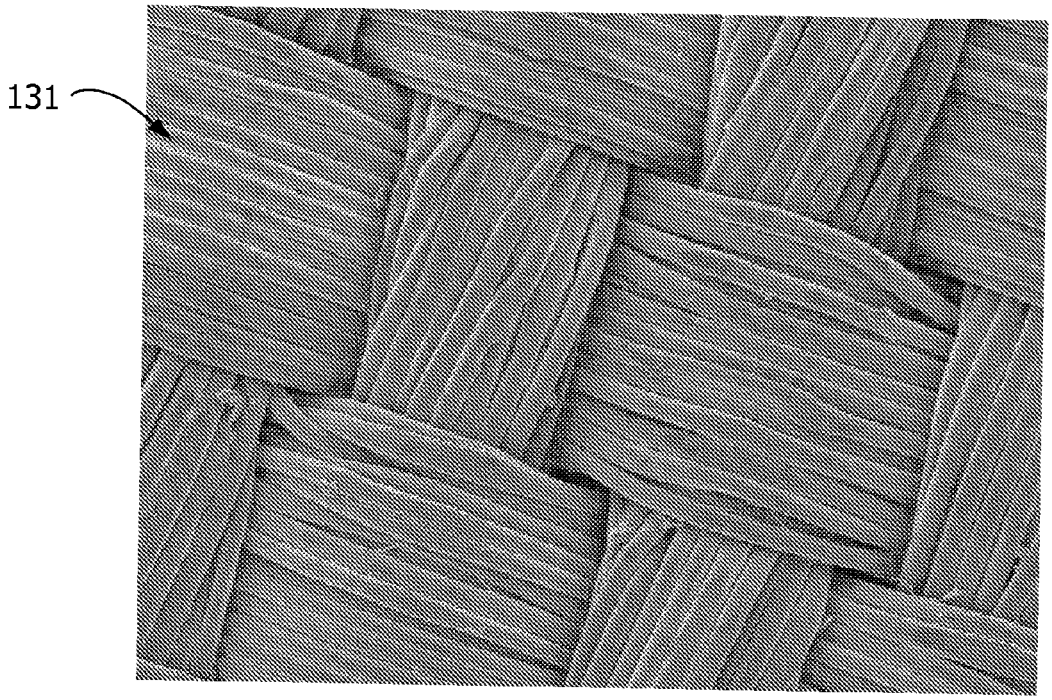
Figure 10:
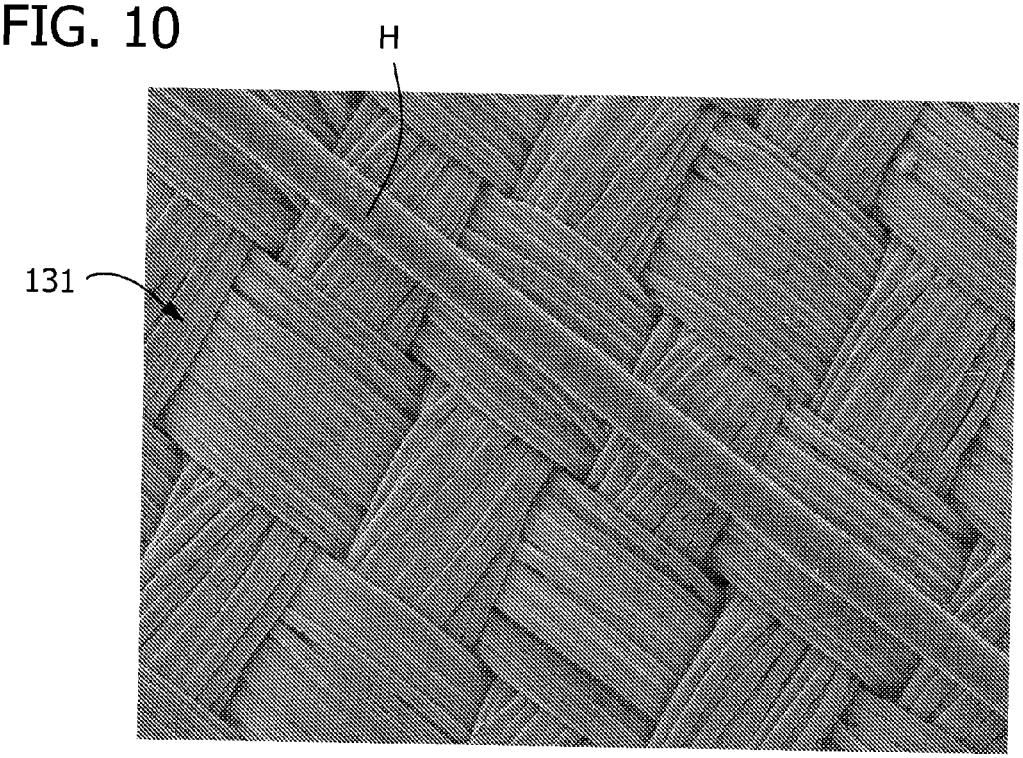
Figure 11:
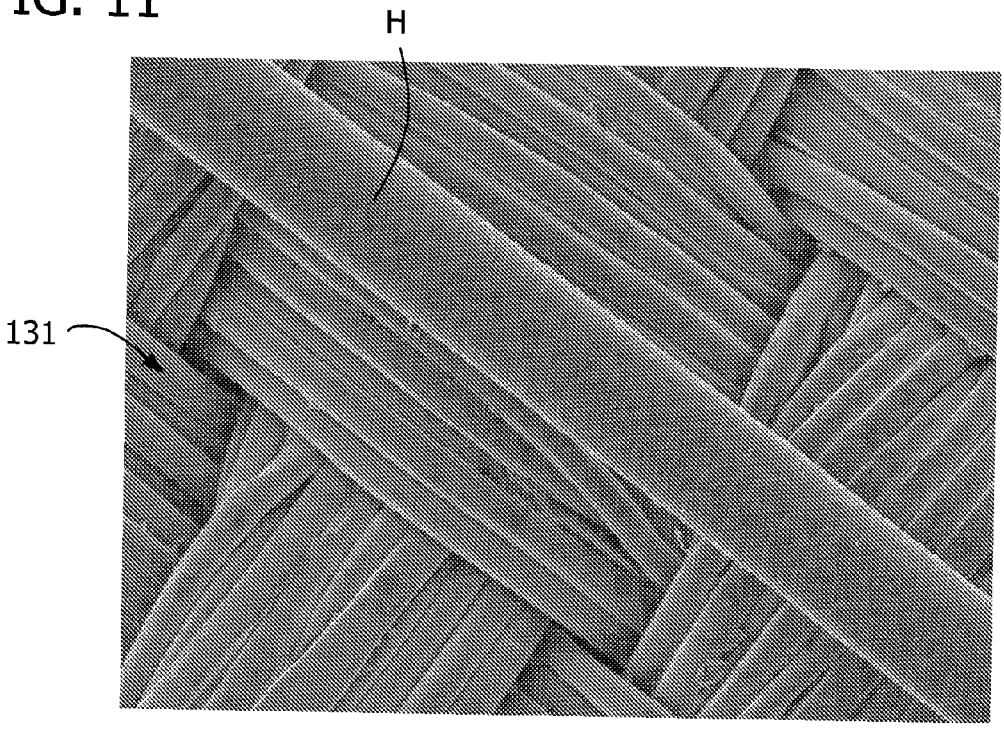
Figure 12:
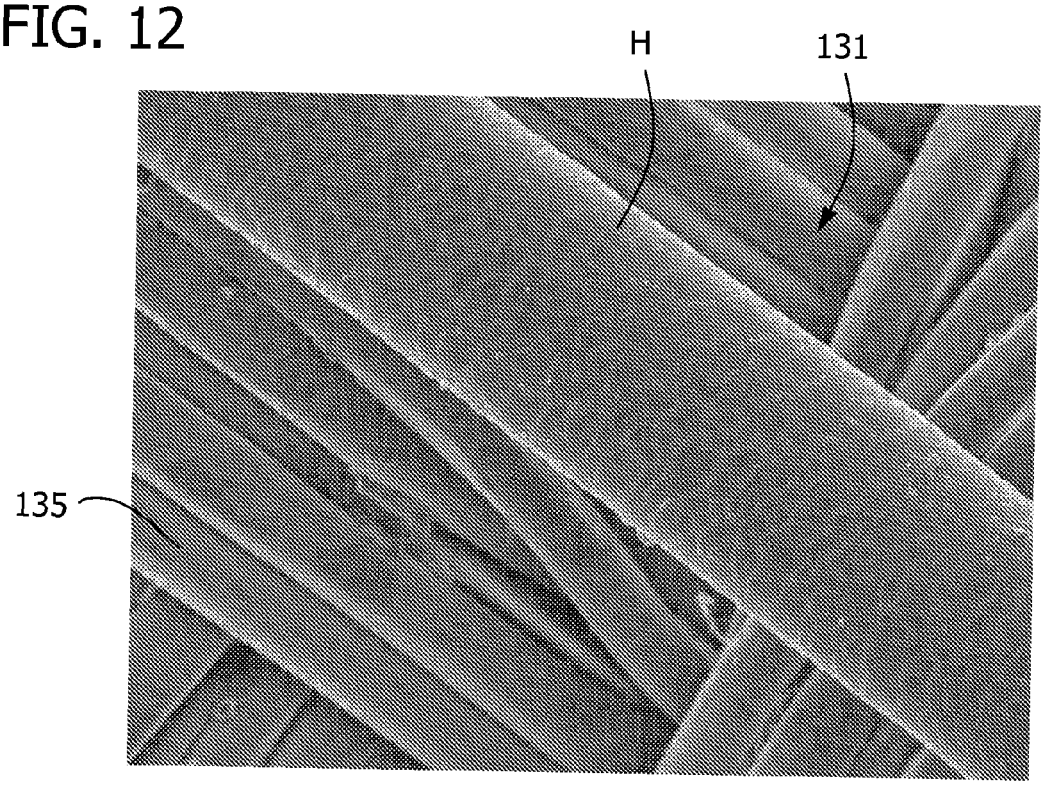
Figure 13:
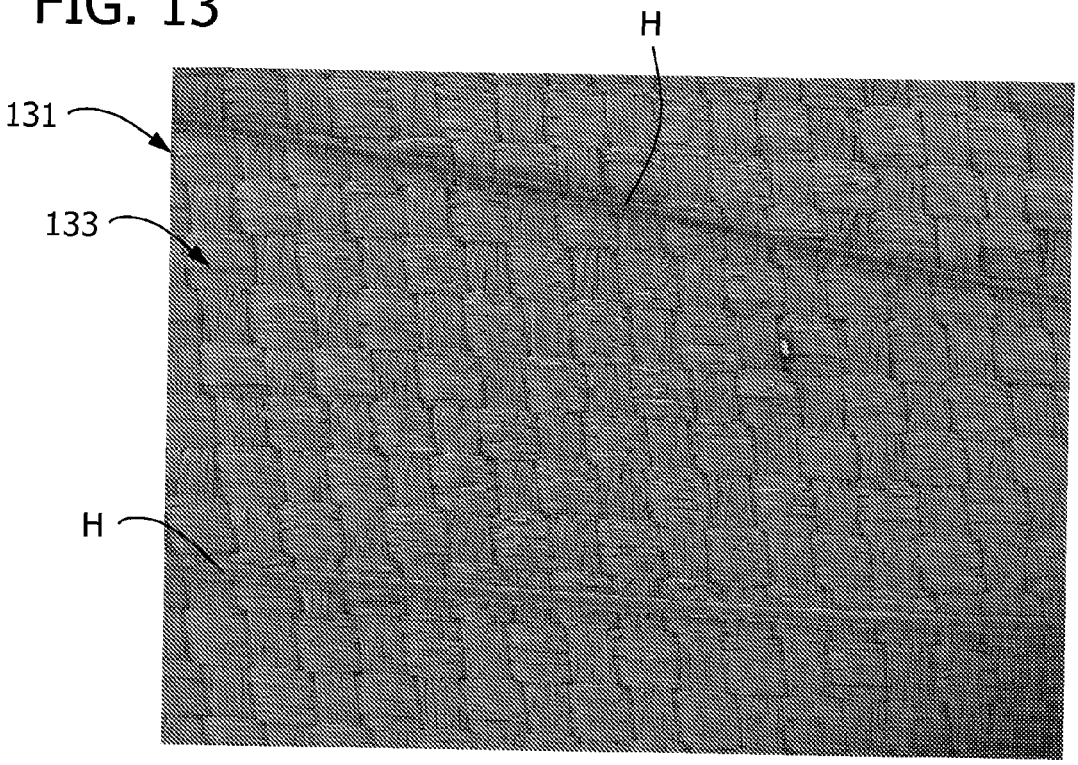
Figure 14:
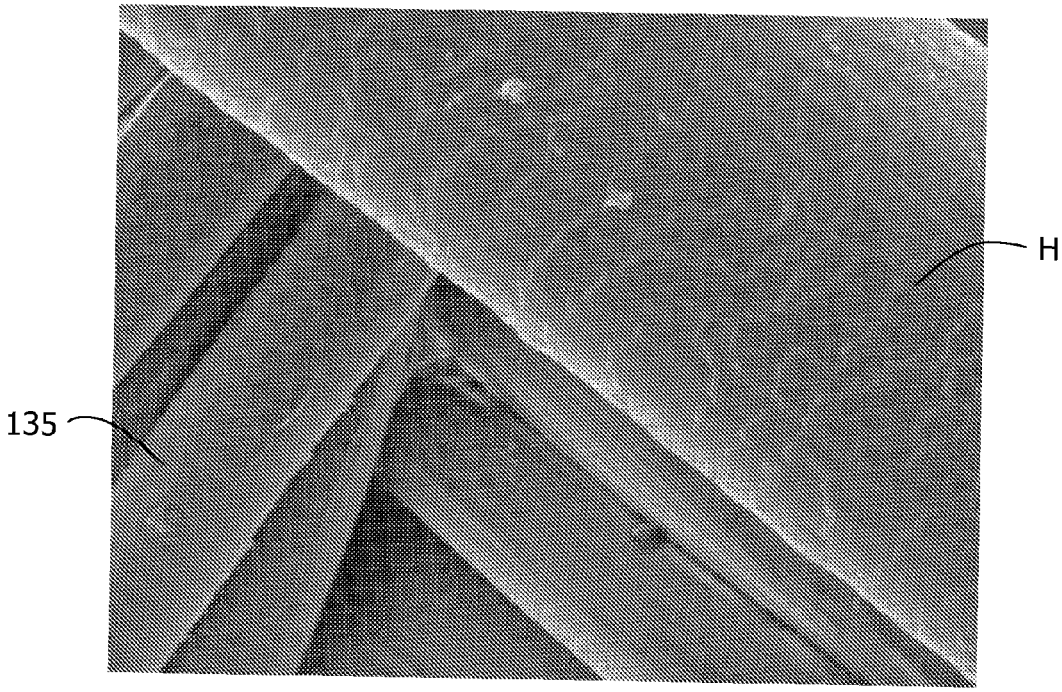
Figure 15:
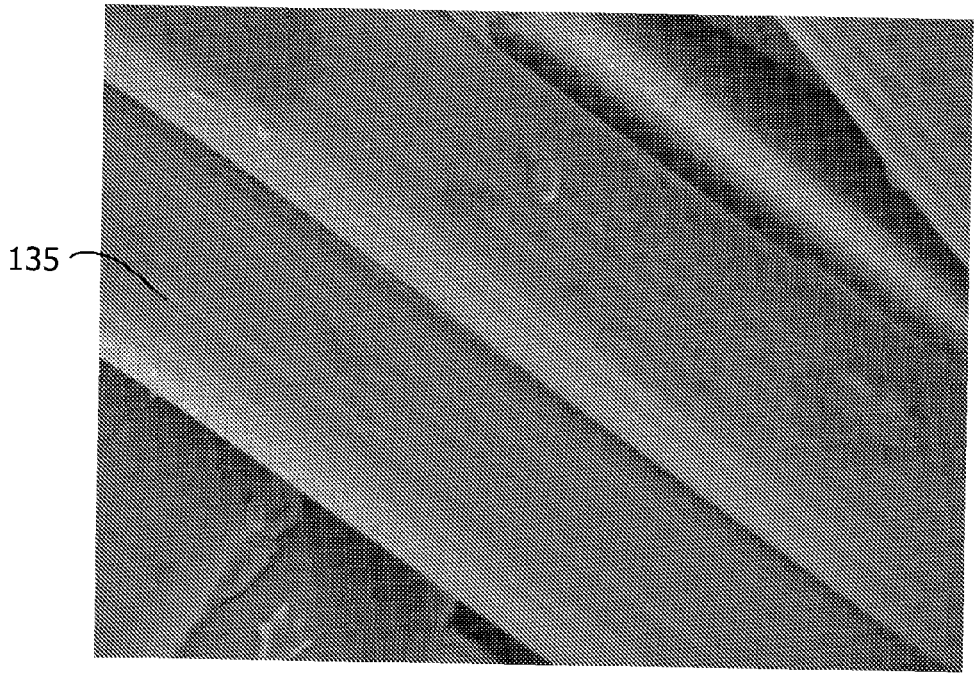

As illustrated in FIGS. 6 and 7, with the cloth 131 pulled taut transversely about the heating member 111, the connectors 161 are attached at opposite ends thereof to the rods 147 disposed in the pockets 145 at the side margins 141 of the cloth to hold the cloth taut on the heating member. In one particularly suitable embodiment, the connectors 161 are configured to apply a tension to the cloth 131, e.g., applied at the side margins 141 thereof, to facilitate maintenance of the cloth in tension, i.e., held taut over the heating member 111 and in particular against the side edges 151 of the heating member to facilitate friction therebetween. Even more suitably the connectors 161 are capable of elastic elongation to maintain tension on the cloth 131 upon heat-induced shrinkage of the cloth.

For example, in the illustrated embodiment the connectors comprise a pair of coil springs 161 having hooks formed at their respective ends to connect the springs to the rods 147 (e.g., by puncturing through the cloth 131 at the pockets 145 thereof). It is contemplated that the connectors 161 may comprise other types of springs, or elastic members, without departing from the scope of this invention. It is also understood that the connectors 161 need not be elastically elongatable, or they may even be inextensible, and remain within the scope of this invention.

In one embodiment, the cloth 131 is held in transverse tension along the length of the heating member in the range of about 0.35 to about 2.10 Newtons per linear centimeter (about 0.2 to about 1.2 pounds per linear inch) of the heating member length (i.e., the length over which the cloth is held in transverse tension), more suitably in the range of about 0.56 to about 1.40 Newtons per linear centimeter (about 0.32 to about 0.8 pounds per linear inch) of the heating member length, and even more suitably in the range of about 0.70 to about 0.98 Newtons per linear centimeter (about 0.4 to about 0.56 pounds per linear inch) of the heating member length. As one example, the length of the heating member 111 of the illustrated embodiment is approximately 2.5 inches (6.35 cm). Accordingly, the tension of the cloth 131 for such a heating member 111 is suitably in the range of about 2.22 to about 13.34 Newtons (about 0.5 to about 3.0 pounds), more suitably about 3.56 to about 8.90 Newtons (about 0.8 to about 2.0 pounds), and even more suitably about 4.45 to about 6.23 Newtons (about 1.0 to about 1.4 pounds).

In a more particular example, each of the two springs 161 of the illustrated embodiment is tensioned to about 2.67 Newtons (about 0.6 pounds) so that the tension in the cloth is about 5.34 Newtons (about 1.2 pounds), or about 0.84 Newtons per linear centimeter (about 0.48 pounds per linear inch) of heating member length. It is understood that the tension in each of the springs 161 need not be equal, i.e., one spring may have a different tension than the other, without departing from the scope of this invention. For example, in the illustrated embodiment one spring may have a tension of about 0.22

Newtons (about 0.5 pounds) while the other has a tension of about 3.11 Newtons (about 0.7 pounds) and still apply a tension to the cloth of about 1.2 pounds. The rods 147 in the pockets 145 formed in the cloth 131 help uniformly distribute this tension from the springs 161 (broadly, the connectors) along the length of the cloth 131.

In one suitable embodiment, the cloth 131 is further constructed of a material in which its static coefficient of friction and its dynamic coefficient of friction are approximately the same (thus having little or no slip-stick) to facilitate reduced (and potentially hair damage inducing) friction between the hair being styled and the hair-facing surfaces 127 of the heating member assemblies 114. In particular, the material from which the cloth 131 is constructed also suitably resists adherence thereto of liquids, gels, sprays or other materials that may be present on the hair being styled. As an example, the cloth 131 may suitably be constructed at least in part from a fluorinated polyethylene, and more suitably it may be constructed at least in part from polytetrafluoroethylene (PTFE) (e.g., such as that commercially available from E.I. DuPont de Nemours and Company under the tradename Teflon®). Alternatively, the cloth 131 may suitably be constructed at least in part from a PTFE derivative. In another particularly suitable embodiment the cloth 131 may be constructed entirely from a fluorinated polyethylene, and more suitably it may be constructed entirely from PTFE or a PTFE derivative.

Even more suitably, the cloth 131 may be constructed of a plurality of monofilaments 135 (FIGS. 8-15), with at least some of the monofilaments comprising at least in part a fluorinated polyethylene, and more suitably at least in part PTFE or a PTFE derivative. In other particularly suitable embodiments the cloth may be constructed of a plurality of monofilaments 135, with at least some of the monofilaments being comprised entirely of a fluorinated polyethylene, and more suitably a PTFE or a PTFE derivative. In still other particularly suitable embodiments, the cloth may be constructed entirely of monofilaments 135, with each of the monofilaments comprised entirely of a fluorinated polyethylene, and more suitably a PTFE or a PTFE derivative. In other suitable embodiments, the cloth may be constructed in part of monofilaments of fluorinated polyethylene and in part of other materials such as aramid fibers (examples include, without limitation, those available from E.I. DuPont de Nemours and Company under the tradenames Kevlar® and Nomex®), fiberglass and other suitable fibers having sufficient temperature resistance to withstand the temperatures at which the hair stylingt apparatus operates.

As used herein, the term "monofilament" refers to a single fiber strand in which its composition is substantially uniform throughout the length and cross-section of the fiber. For example, in one embodiment the monofilaments 135 may be formed by extruding a heated polymeric material (e.g., PTFE or a derivative thereof) or polymeric material mixture through an opening to produce a fiber of substantially uniform polymer or polymer mixture throughout the strand. As shown in FIGS. 8-15, the monofilaments 135 of the illustrated embodiment are suitably sized smaller in diameter than a typical human hair (which tends on the average to be about 80 to about 100 microns in diameter). For example, the monofilaments 135 may each have a diameter of about 25 to about 30 microns. It is understood, however, that the monofilaments 135 may be sized larger or smaller than the above range without departing from the scope of this invention.

A multiple component filament (which is not a monofilament as that term is defined herein) is also a single fiber but comprises at least two distinct materials that are not blended or otherwise mixed together, i.e., the distribution of material is non-uniform along the length and/or cross-section of the fiber. It is understood that the cloth 131 may be constructed in part or in whole of such multiple component filaments without departing from the scope of this invention. For example, the cloth 131 may comprise multiple component filaments in which a fibrous material such as fiberglass or other fibrous material that is capable of withstanding the operating temperatures of the heating member 111 is coated or otherwise covered with a fluorinated polyethylene, and more suitably a PTFE or a PTFE derivative.

The cloth 131 of the illustrated embodiment is suitably a woven cloth. The term "woven" refers to the interlacing of warp and fill (otherwise commonly referred to as weft) members in a predetermined pattern. For example, in one embodiment the weave of the cloth 131 may comprise a plain weave made by weaving one fill member over and under each warp member, alternating each row. It is understood, however, that weaves other than a plain weave may be used to construct the woven cloth 131, such as a twill, basket, satin or other suitable. More suitably, as illustrated for example in FIGS. 8-15, the cloth 131 is woven from a plurality of yarns 133, i.e., at least one of the warp members and the fill members are yarns, and even more suitably both the warp members and the fill members are yarns. The term "yarn" as used herein refers to two or more fibers or filaments bundled together to form a single yarn strand, whether or not the fibers or filaments are spun, twisted or otherwise held together as a bundle. In one particularly suitable embodiment, each of the yarns from which the cloth is woven comprises a plurality (i.e., two or more) of the monofilaments comprised at least in part of, and more suitably entirely of a fluorinated polyethylene, and more suitably a PTFE or a PTFE derivative. As an example, in one embodiment each yarn may suitably comprise about 60 such monofilaments 135.

The cloth 131 is suitably oriented on the heating member 111 with the warp direction of the cloth extending in the longitudinal direction of the heating member and the fill direction of the cloth extending in the transverse direction of the heating member. However, it is contemplated that the warp direction of the cloth 131 may be oriented in the transverse direction of the heating member 111, with the fill direction thereby being oriented in the longitudinal direction of the heating member, or the cloth may be oriented in another orientation relative to the heating member, without departing from the scope of this invention.

In a more particular example, one suitable cloth 131 has a yarn count (also commonly referred to as a thread count) of about 75 to about 78 yarns/inch in the warp direction and about 62 to about 69 yarns/inch in the fill direction (as determined using ASTM standard D-3775). The cloth 131 is woven of 400 denier Teflon®, with each yarn comprising about 60 monofilaments 135. The thickness of the cloth is approximately 0.0088±0.0008 inches (as determined using ASTM standard D-1777) and a basis weight of about 8.5±0.5 ounces per square yard (osy) (as determined by ASTM standard D-3776). The tensile strength in both the warp and fill direction is at least about 95 pounds (as determined by ASTM standard D-5035 using a one inch ravel strip) and an elongation of at least 30 percent in both the warp and fill direction (also determined by ASTM standard D-5035 using a one inch ravel strip). The cloth 131 may also have an air permeability at 0.5 inches of at least about 10 cubic feet/minute (CFM) (as determined by ASTM standard D-737). Such a construction allows some movement of the yarns and/or the individual monofilaments thereof relative to one another (i.e., there is some "looseness" in the weave). The shrinkage of the cloth in the warp direction is suitably less than about four percent and the shrinkage of the cloth in the fill direction (e.g., the transverse direction of the cloth/heating member in the illustrated embodiment) is less than about eight percent.

One advantage of constructing the cloth 131 at least partially from fluorinated polyethylene monofilaments 135 is that tension is induced in the cloth upon heating thereof (e.g., upon initial heating of the heating member 111) because of the heat induced shrinkage of the monofilaments 135 (and hence the cloth) as discussed previously.

While in the illustrated embodiment the cloth 131 is a woven cloth comprised of yarns, it is contemplated that in other embodiments the cloth may be woven from individual fibers or filaments, such as the monofilaments 135 described previously herein, without departing from the scope of this invention. It is also contemplated that the cloth 131 may alternatively comprise a non-woven cloth and remain within the scope of this invention.

The heating member assembly (not shown) carried by the upper arm 103*b* similarly comprises a cloth (not shown, but broadly defining a second cloth) covering the outer, hair-facing surface of the heating member thereof and thereby defining an outer, hair-facing surface of the upper arm. It is understood, however, that only the heating member assembly 114 of the lower arm 103*a*, or only that of the upper arm 103*b*, may comprise a heating member 111 covered by the above described cloth 131 and remain within the scope of this invention.

The hair straightener 101 is used in generally the same manner as a conventional hair straightener. The heating members 111 of the heating member assemblies 114 are heated by the heating units 117. Once the heating member assemblies 114 reach their desired temperature, the user moves the lower and upper arms 103*a*, 103*b* relative to each other from the open position to the closed position of the hair straightener 101 so that a swatch of hair is held between the opposed hair-facing surfaces 127 of the arms (e.g., between the cloths 131 that cover the respective heating members 111). The user applies pressure to the arms 103 to clamp the hair firmly between the heating members 111. Although the technique may vary from one user to the next, the hair is typically oriented at least roughly perpendicularly to the arms 103*a*, 103*b*. The straightener 101 is passed over the length of the hairs, for example by pulling the straightener away from the subject's scalp without opening the arms 103*a*, 103*b* to pull all or part of the entire length of hair through the arms. Heat from the heating members 111 is transferred to the hair while it is held between the cloth-covered heating members 111, which in combination with the pressure applied by the user results in straightening of the hair.

Although the technique for operating the hair straightener 101 is substantially the same as it is for conventional straighteners, the cloth 131 reduces the amount of damage that may occur to the hair as a result of the straightening process. In particular, the cloth 131 is suitably less thermally conductive than the heating member and therefore remains slightly cooler than the heating member. Moreover, while conductive heat transfer from the cloth 131 to the hairs H occurs where the hairs actually contact the cloth, the woven structure of the cloth 131 and the irregular surface of the yarns 133 resulting from the bundling of monofilaments 135 reduces the contact surface between the hairs H and the cloth. Numerous small pockets of hot air exist in the pores of the woven cloth 131 and between locations where a strand of hair H contacts the cloth. The heated parcels of air can rise through the hairs H to reach other hairs that are not in contact with the cloth 131 at that moment. The construction of the cloth 131 also results in a relatively high surface area density, which increases the availability of heat stored in the cloth for transfer to the hairs H without increasing the temperature. These features work in concert to reduce the likelihood that heat damage will be inflicted on the hair during straightening, while facilitating effective heating of the hair required to achieve straightening.

The cloth 131 also protects hairs from physical damage. For example, the construction of the cloth 131 allows some movement of the yarns 133 relative to each other, and/or the individual monofilaments or other fibers relative to each other, as the hairs are compacted between the heating member assemblies. This movement can absorb some of the pressure applied by the user to reduce the pressure applied to the hairs H. Further, the cloth 131 in general is more yielding (e.g., compressive) than the heating member 111 so that the hairs H are cushioned to some extent from the tendency of the relatively non-pliable heating member to otherwise crush individual hairs.

The irregular surface area of the cloth 131 (e.g., due to the individual monofilments and the weaving of the yarns) creates the opportunity for individual hairs H to be gripped as they pass over the cloth. In particular, the orientation of the monofilaments, i.e., extending generally parallel to each other, allows the hair-facing surface defined by the cloth to act somewhat in a comb-like manner, thereby inhibiting the hairs to cross-over each other or become skewed to the direction in which the straightener is pulled relative to the hairs.

The relatively low coefficient of friction provided by the cloth 131 material reduces the amount of friction applied to the hairs. This is particularly true of cloths that include fluorinated polyethylene and in particular PTFE or a PTFE derivative. The low coefficient of friction in combination with the smooth rounded shape of the monofilaments 135 (as is evident in FIG. 12, for example) allows the hairs H to glide over the cloth 131 with reduced risk of damage to the hairs.

A Hair Damage Assessment Test as set forth below may be used to determine the amount of damage that occurs to hair as a result of using a particular hair straightener. In one embodiment, the amount of hair damage resulting from using a hair straightener constructed in accordance with the present invention and operated at a temperature of at least about 150 degrees Celsius is suitably less than or equal to about 40 percent, more suitably less than or equal to about 30 percent, and even more suitably less than or equal to about 20 percent as determined by the Hair Damage Assessment Test.

In another suitable embodiment, the amount of hair damage resulting from using a hair straightener constructed in accordance with the present invention and operated at a temperature of at least about 170 degrees Celsius is suitably less than or equal to about 40 percent, more suitably less than or equal to about 30 percent, and even more suitably less than or equal to about 20 percent as determined by the Hair Damage Assessment Test.

In yet another suitable embodiment, the amount of hair damage resulting from using a hair straightener constructed in accordance with the present invention and operated at a temperature of at least about 190 degrees Celsius is suitably less than or equal to about 40 percent, more suitably less than or equal to about 30 percent, and even more suitably less than or equal to about 20 percent as determined by the Hair Damage Assessment Test.

Hair Damage Assessment Test

A swatch (about one gram, which on average comprises about 1,000 to about 1,200 hairs) of virgin hair (in excellent condition and showing no signs of damage) is washed with a non-silicone shampoo. No conditioners or styling agents are applied to the hair after washing. Before testing, the hair straightener to be tested is turned on to the maximum heat setting and allowed to heat up for at least three minutes. The temperature of the heated hair-facing surface(s) of the hair straightener is measured (e.g., by a suitable thermometer placed in contact with the hair-facing surface) and recorded.

The swatch is then subjected to 500 passes through the hair straightener (e.g., in the closed position of the hair straightener). Assuming that users average four passes each time they use a hair straightener to straighten hair, 500 passes is intended to simulate approximately 125 actual uses of the respective hair straightener. The compression pressure applied by the tester should be kept as uniform as possible from one pass to the next. Following completion of the 500 passes, the swatch is hung on a hook in a room having an ambient temperature of 21 degrees Celsius (i.e., room temperature) for several hours.

Figure 23:
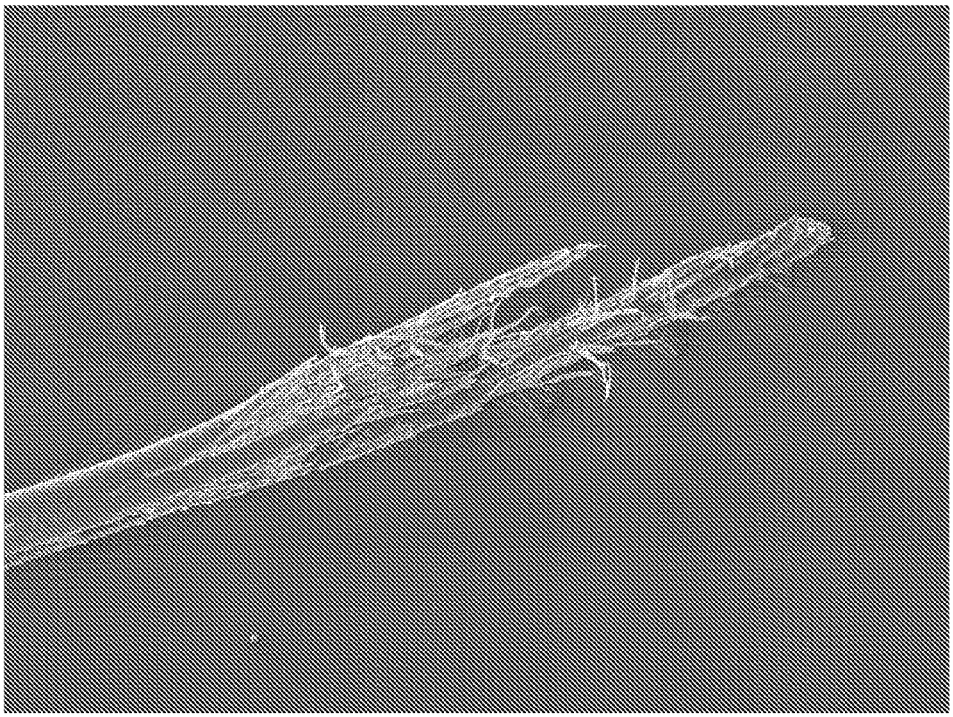

The term damage as used for this Test refers to split ends and defects/distortions at any point along the hair shaft. For example, FIG. 23 is a scanning electron micrograph of a hair having a split end, i.e., longitudinal splitting at, or close to, the ends of the hair and a complete breakdown of the cortical fibers. For purposes of this Test, a hair that is broken at the end of the shaft is considered a split end even if there is not an actual split. For example, some ends can have what is referred to as a "paintbrush effect" (i.e., some degree of fraying of the shaft at the end) which typically progresses into an actual split at the end of the hair shaft.

Figure 24:
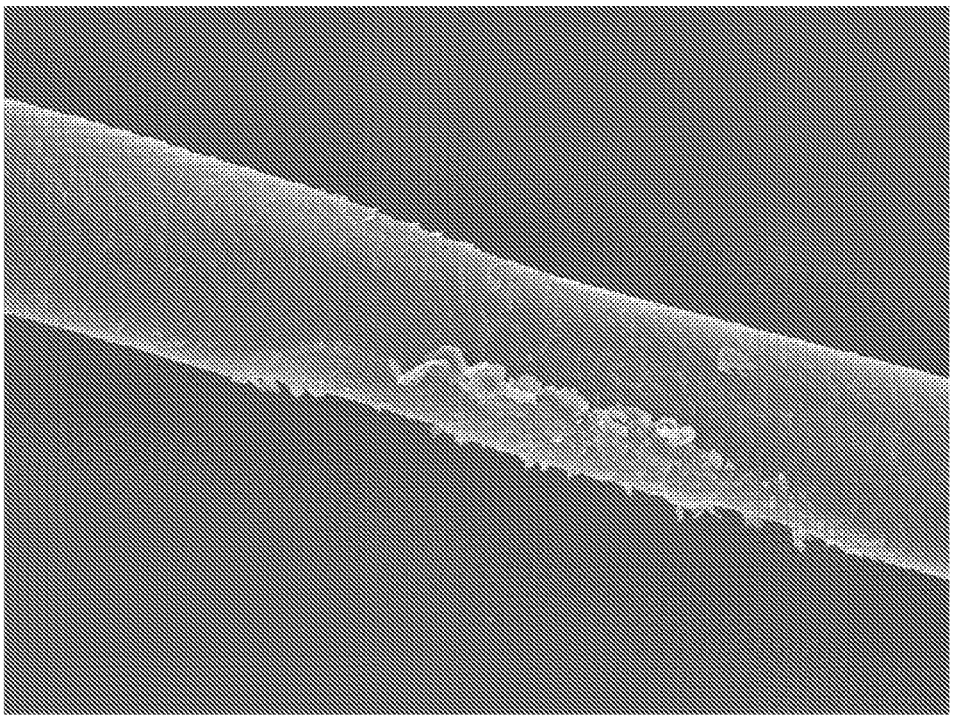
Figure 25:
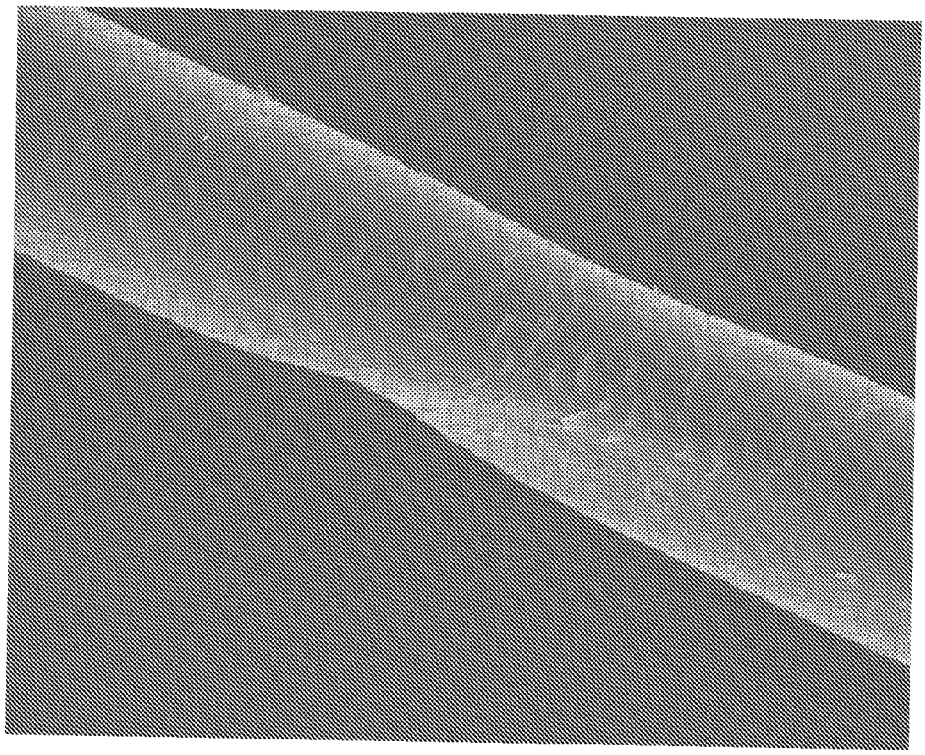
Figure 26:
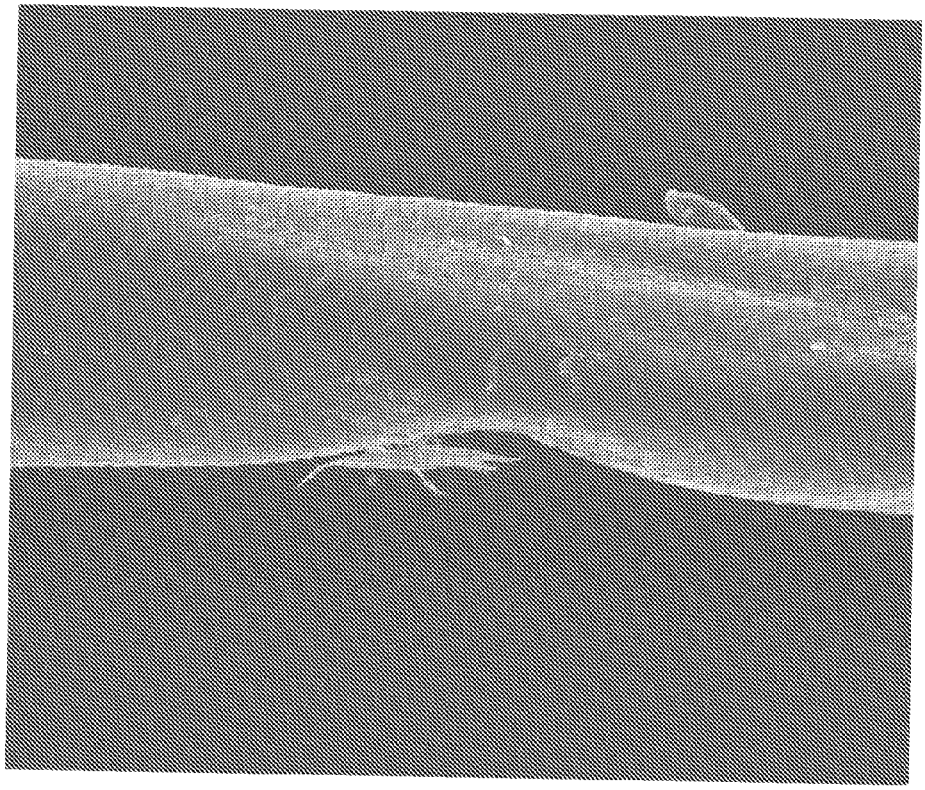
Figure 27:
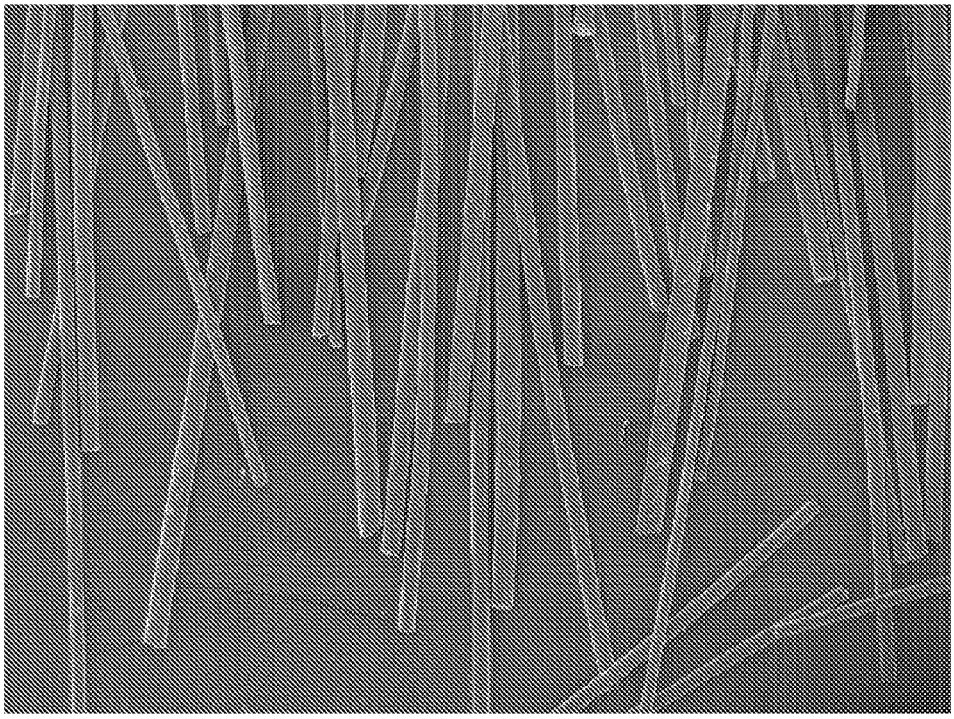
FIGS. 27-29 are scanning electron micrographs of hair following treatment of the hair by a hair straightener such as the hair straightener of FIG. 1.

FIGS. 24-26 illustrate other types of damage/distortion that are considered to be structural damage for the purposes of this Test. In particular, FIG. 24 shows cuticle scale loss resulting from frictional damage to a hair. FIG. 25 shows an indentation formed in a hair shaft, possibly due to application of heat and/or pressure to the hair while pressed against an adjacent hair having a slightly skewed orientation. FIG. 26 shows cuticle scales in the process of breaking away from an indentation similar to the indentation shown in FIG. 25. Other types of damage considered to be structural damage for the purposes of this Test include breakage of the cuticle layer to expose broken cortical fibers and "swelling" of hair (due to bubble hair, the start of trichohexis nedosa, or a combination of the two). Bends, kinks, or indentations in the hair were also considered to be structural damage for purposes of this Test.

Although damage to hairs for the purpose of this Test may be determined without the aid of a scanning electron microscope, the micrographs shown in FIGS. 23-26 are useful in conveying an understanding of the type of damage considered to be structural damage for this Test.

Two hundred hairs are selected from two sections of the swatch after testing the hair straightener. This set of hairs is examined under a high powered magnifying lens for structural damage to the hairs of the swatch. The percentage of damaged vs. undamaged hairs is then tabulated and recorded.

Experiment 1

An experiment was conducted to compare the damage to hair resulting from using a conventional hair straightener (e.g., with the cloth covering described above) to damage resulting from using a hair straightener 101 constructed in accordance with the present invention. Twenty-four swatches of virgin hair in excellent condition and showing no signs of damage were selected at random and washed with a non-silicone shampoo. No conditioners or styling agents were applied to the hair after washing. The swatches were randomly divided into three groups (A, B, and C), with each group containing eight swatches.

Group A swatches were subjected to the above Hair Damage Assessment Test using a conventional hair straightener (a Remington S2002 hair straightener available from Spectrum Brands, Inc. of Atlanta, Ga.), while the Group B swatches were subjected to the Hair Damage Assessment Test using the Remington S2002 hair straightener with the hair-facing surfaces of its heating members each covered with a plain woven PTFE cloth according to the present invention. In particular, the cloth had a yarn count (also commonly referred to as a thread count) of about 75 to about 78 yarns/inch in the warp direction and about 62 to about 69 yarns/inch in the fill direction (as determined using ASTM standard D-3775), with the warp direction extending longitudinally on the heating member of the hair straightener. Each yarn comprised about 60 Teflon® monofilaments 135. The cloth had a thickness of approximately 0.0088±0.0008 inches (as determined using ASTM standard D-1777) and a basis weight of about 8.5±0.5 ounces per square yard (osy) (as determined by ASTM standard D-3776). The tensile strength in both the warp and fill direction was at least about 95 pounds (as determined by ASTM standard D-5035 using a one inch ravel strip) and an elongation was at least 30 percent in both the warp and fill direction (also determined by ASTM standard D-5035 using a one inch ravel strip). The cloth 131 also had an air permeability at 0.5 inches of at least about 10 cubic feet/minute (CFM) (as determined by ASTM standard D-737). The swatches in Group C remained untreated for use as a control. There was damage to the hairs in the swatches of Group C.

Four testers were used to conduct the test, e.g., with each tester applying all 500 passes to a particular swatch with a particular hair straightener. The testers were instructed to maintain the compression pressure applied to the swatch as uniform as possible from one pass to the next. Before testing, each of the hair straighteners were turned on to the maximum heat setting and allowed to heat up for four minutes. The temperature of the heated hair-facing surfaces of the straightener was measured to be about 190.0 degrees Celsius for the conventional hair straightener and about 182.5 degrees Celsius for the hair straightener having the cloth covered heating members.

Figure 21:
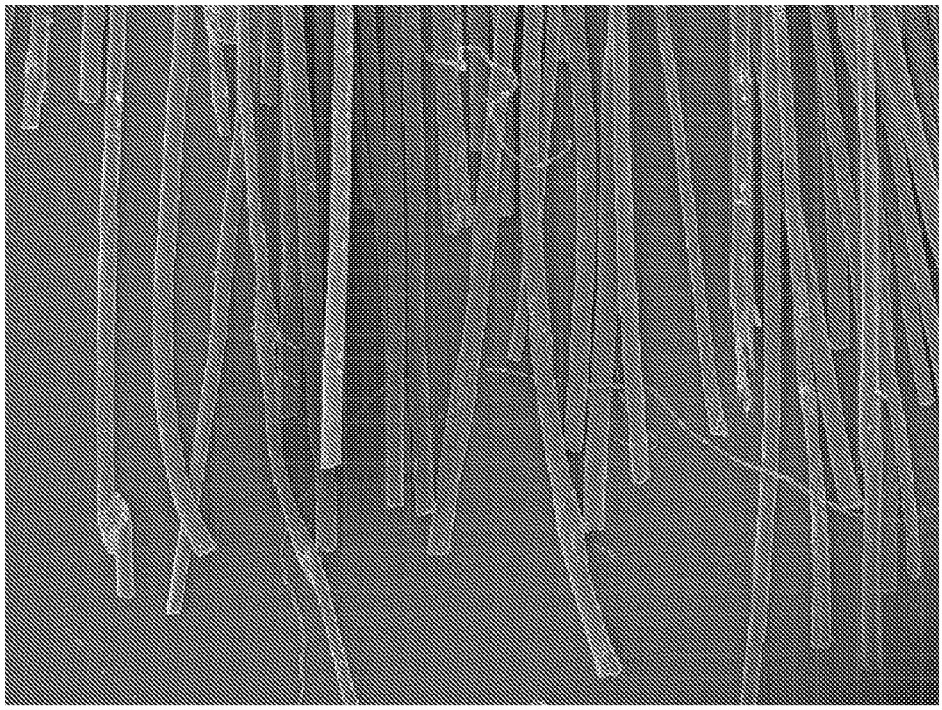
FIGS. 21-26 are scanning electron micrographs of hair showing various types of damage that can occur to hair.
Figure 22:
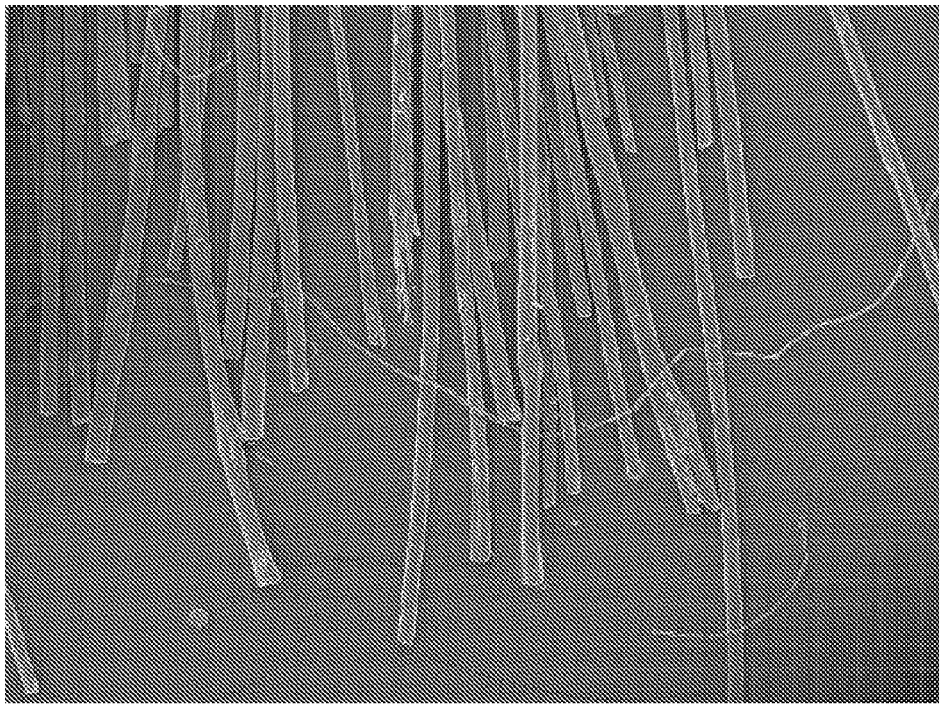

Each swatch from Group A and Group B was then examined under a high powered magnifying lens for structural damage to the hairs of the swatch. For example, FIGS. 21 and 22 are scanning electron micrographs of the ends of some of the hairs in the representative swatch from Group A. The swatches in each of Groups A and B containing the most severely damaged hairs and the swatches containing the least damaged hairs were discarded. After further examination of each of the remaining six swatches in Group A and Group B, one swatch was selected from each group as being most representative of that group. Two hundred hairs were selected from two sections of each swatch. The hairs from the representative swatches were further examined under a high powered magnifying lens for structural damage to the hair shafts and ends. The percentage of damaged vs. undamaged hairs was tabulated and the results are provided below:

Hair Shaft Structural Damage

Group A—60.5% of hair shafts were damaged

Group B—18.5% of hair shafts were damaged

The most common structural damage to the Group A hairs was split ends. In particular, 52.0 percent of the hairs in the Group A swatch had split ends.

Figure 28:
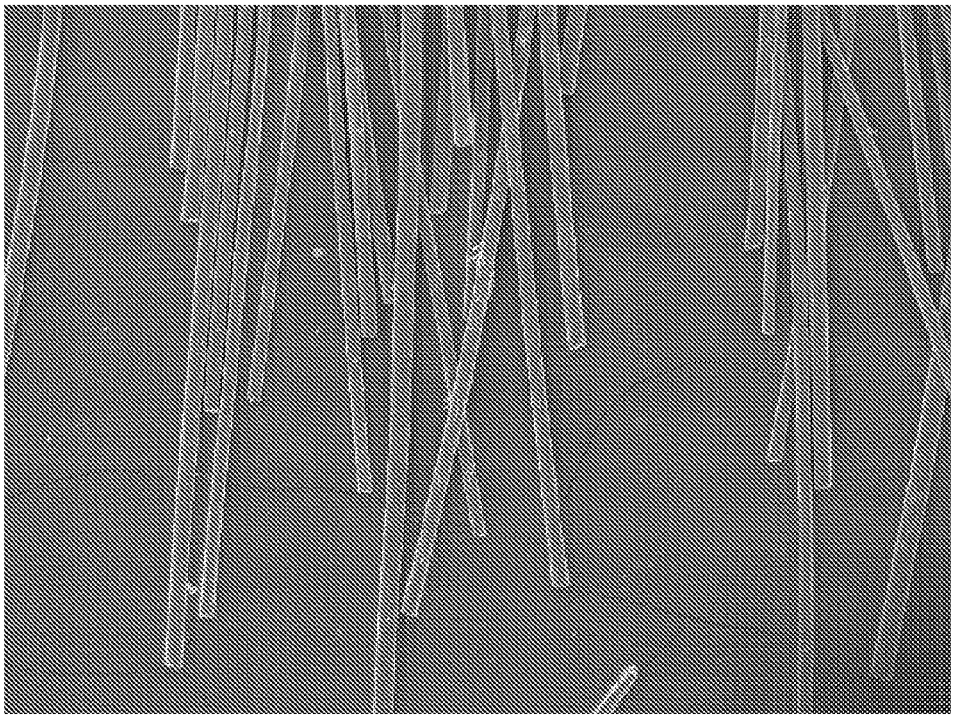
Figure 29:
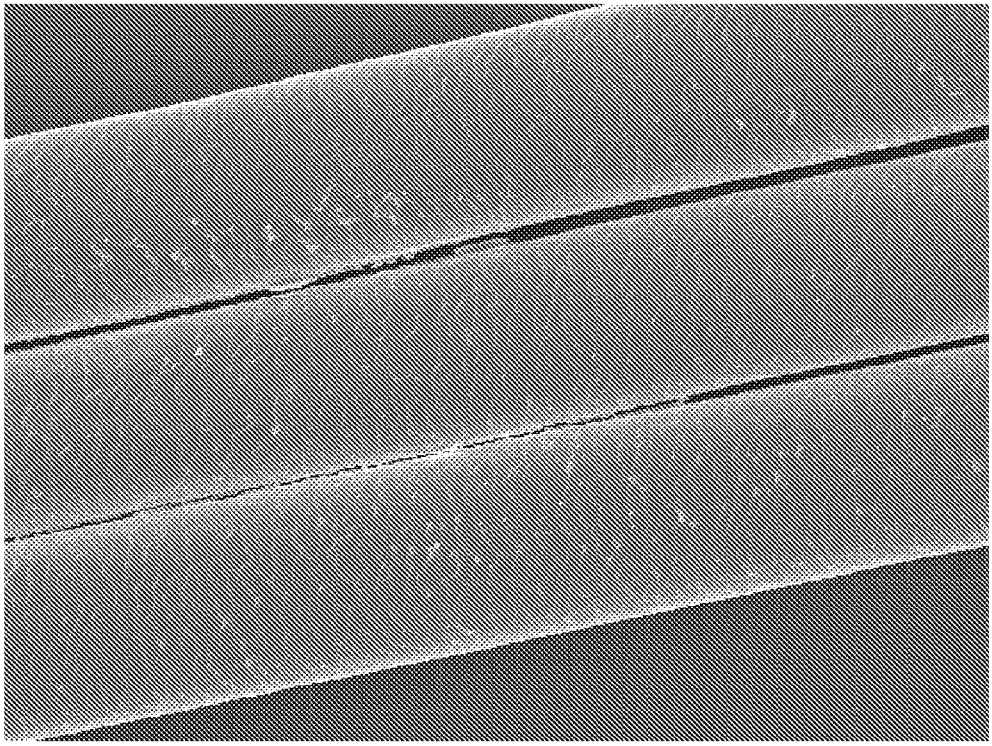

FIGS. 28 and 29 are scanning electron micrographs of some of the hairs in the representative swatch from Group B. Only 5.0 percent of the 200 hairs from the swatch of Group B had split ends. Cuticle scales were damaged or removed in some areas of other damaged hairs. However, cuticle damage was significantly less frequent with the hair straightener having cloth-covered heating members than it was with the conventional hair straightener. Some hairs also had indentations that were likely the result of heat and/or pressure being applied to the hair while it was pressed against a neighboring hair that had a slightly skewed orientation. Further, where damage did occur to the hair shaft, there appeared to be some qualitative differences in the nature of the damage in that a greater percentage of the damage was noted to be bends, kinks, or indentations formed in the shaft. Although these features are considered damage in accordance with the Hair Damage Assessment Test in that they may weaken the hair, they are less likely to lead to structural breakdown of the hair than the cuticle damage shown in FIGS. 24 and 26.

Experiment 2

A second Experiment was conducted to compare the hair damage caused by several commercially available hair styling apparatus with that resulting from the hair straighteners tested in Experiment 1. Virgin hair swatches similar to those used in Experiment 1 were washed as described above. The various hair styling apparatus were first turned on at the maximum heat setting and allowed to warm up for three minutes. Then the temperature of the apparatus was measured by a thermometer in contact with the hair-facing surface of the heating member. The swatches and corresponding hair-styling apparatus were subjected to the above-described Hair Damage Assessment Test, the results of which are set forth below (along with the results from Experiment 1):

| Styling Apparatus (e.g., Brand and Model) | Hair Shaft Structural Damage | Temperature |
|---|---|---|
| Hair Straightener having cloth-covered heating members (from Experiment 1) | 18.5% | 182.5° C. (after four minutes per Experiment 1) |
| Remington S2002 (from Experiment 1) | 60.5% | 190° C. (after four minutes per Experiment 1) |
| Babyliss 2025HU | 41% | 142° C. |
| Vidal Sassoon VS5312 | 47% | 189° C. |
| Tresemme HP4642 | 49% | 161° C. |
| Braun 3543 | 45% | 151° C. |
| Philips Influence HP4647 | 52% | 176° C. |
| Babyliss Paris 2025CE | 60% | 160° C. |
| Conair Satin Finish CS4J (w/ Turbo Boost on) | 42% | 179° C. |
| Vidal Sassoon VS182C | 49% | 151° C. |
| Conair Infinity CS131 | 53% | 155° C. |

These results support the conclusion that covering the heating members of the hair straightener with a cloth constructed in accordance with the present invention results in less structural damage to the hair shaft than conventional hair straighteners.

Similar benefits can be attained by covering the heating member(s) of other types of hair styling apparatus with a cloth as described above. For example, FIGS. 16-20 illustrate a second embodiment of a hair styling apparatus of the present invention, generally designated 201, in the form of a curling iron for curling hair.

The curling iron 201 comprises an elongate handle 202 having an elongate heating member assembly 203 extending therefrom (the handle and heating member assembly together broadly defining an arm comprised of at least one heating member assembly). The illustrated heating member assembly 203 comprises a generally cylindrical heating member 205 having an inner surface 206 defining an interior space 207 of the heating member and an outer, hair-facing surface 209 thereof. A heating unit 215 in the form of one or more electrical resistance heaters is disposed generally centrally within the interior space 207 of the heating member 205 and in thermally conductive contact with the inner surface 206 of the heating member via a pair of thermally conductive heat distributors 217 (e.g., constructed of aluminum) also disposed within the heating member. The heating member 205 itself may be constructed of metal, ceramic or any other suitable material or combinations thereof and capable of withstanding heating to a temperature of about 150 to about 250 degrees Celsius. As seen best in FIG. 19, an elongate slot 219 (the purpose of which is described later herein) is formed in the heating member 205 and extends along the length of the heating member.

Figure 19:
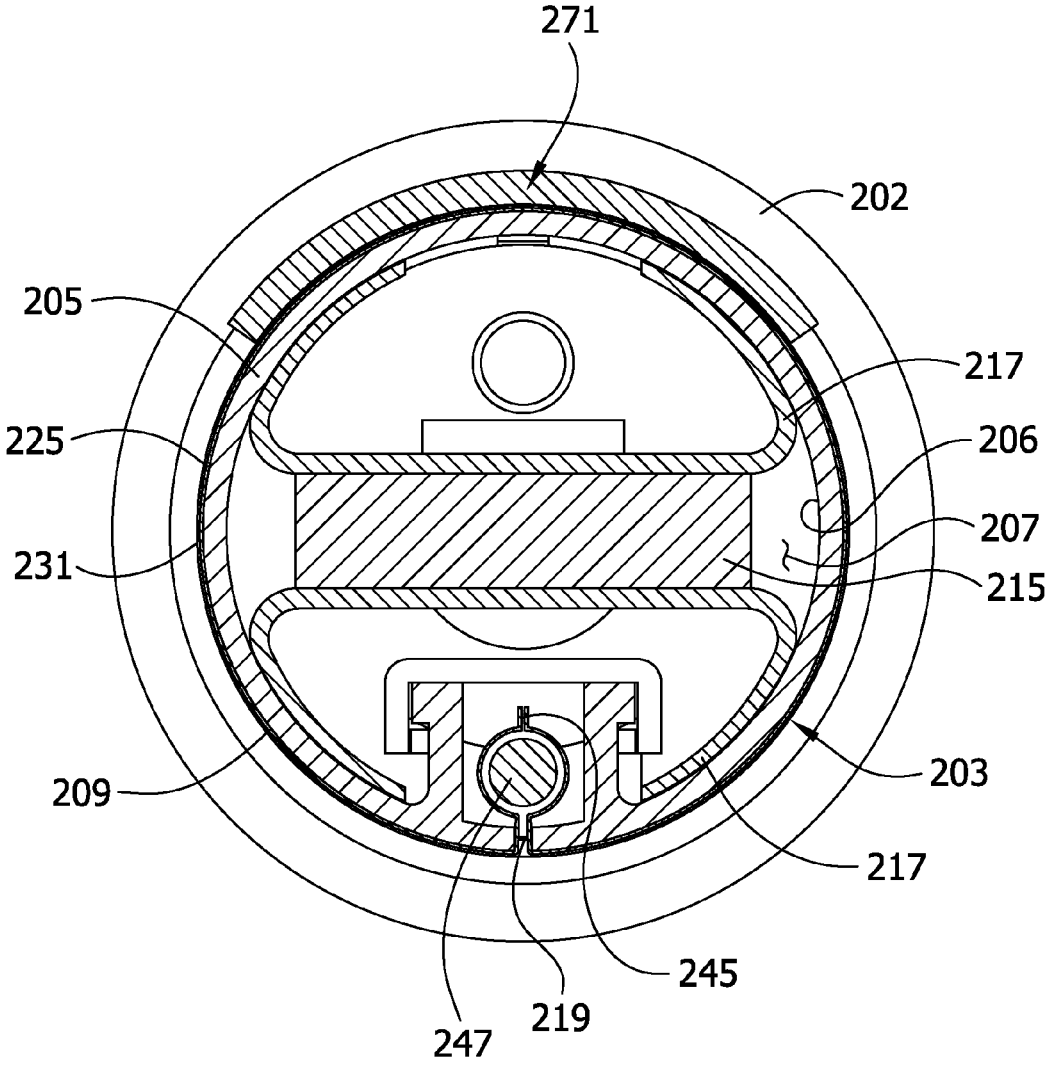
FIG. 19 is a section view of the curling iron of FIG. 18 taken in a plane including the line 20-20 of FIG. 19.
Figure 20:
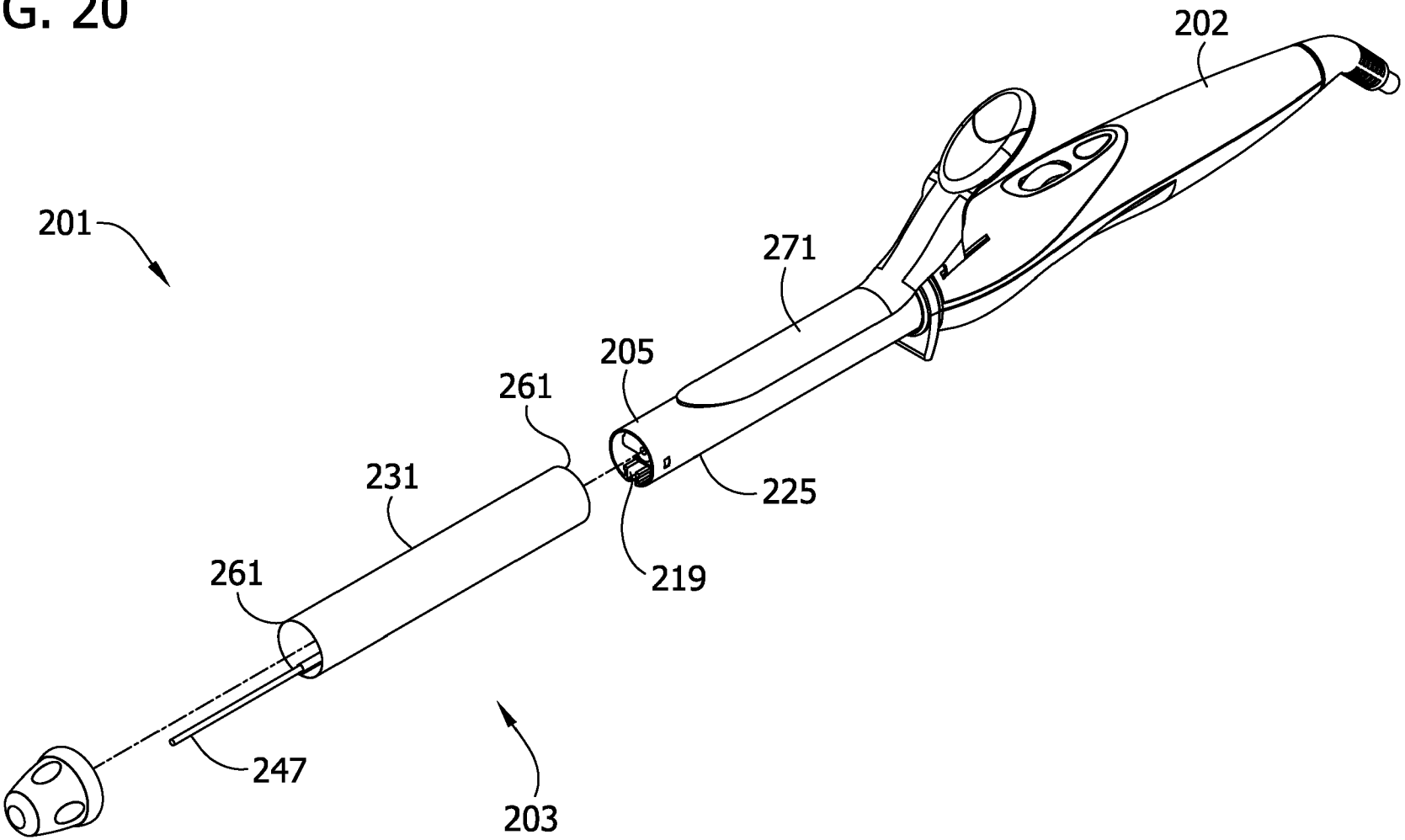
FIG. 20 is an exploded perspective of the curling iron of FIG. 16.

With particular reference to FIGS. 19 and 20, a cloth 231 is wrapped around the heating member 205 to cover at least a portion, and more suitably all of the hair-facing surface 209 of the heating member 205. The cloth 131 thus defines an outer, hair facing surface 225 of the heating member assembly 203 (and hence, broadly, of the arm defined by the handle 202 and heating member assembly). The cloth 231 may be suitably constructed in any of the manners described previously in connection with cloth 131 that covers the heating members 111 of the hair straightener 101 of FIGS. 1-7. In a particularly suitable embodiment, the cloth 231 is held taut on the heating member 205 to inhibit bunching, wrinkling or other movement of the cloth relative to the heating member during use.

For example, in one embodiment the cloth 231 is initially (i.e., before wrapping about the heating member 205) generally rectangular and has transverse side margins that are stitched together along a longitudinally extending seam 245 to form the cloth into a generally tubular configuration. The tube formed by the cloth 231 is suitably sized in cross-section larger than the heating member 205 to allow the cloth to be fitted over the heating member with some slack remaining in the cloth. This slack in the cloth 231 is taken up by inserting a portion of the cloth (e.g., along the seam 245) through the slot 219 formed in the heating member 205 so that the cloth becomes taut on the outer, hair-facing surface 209 of the heating member.

The portion of the cloth 231 inserted through the heating member slot 219 forms an elongate pocket in which a rod 247 (e.g., a steel rod) having a diameter that exceeds the width of the slot 219 in the heating member 205 is received to hold the cloth taut over the hair-facing surface 209 of the heating member. The longitudinal ends of the cloth 231 are suitably wrapped around the longitudinal ends of the heating member 205 and tucked into the interior space 207 thereof. When fully assembled in this manner, the seam 245 and longitudinal ends of the cloth 231 are inaccessible to the user. The tension in the cloth 231 is suitably in the same range as noted above for the cloth 131 of the hair straightener 101.

Figure 16:
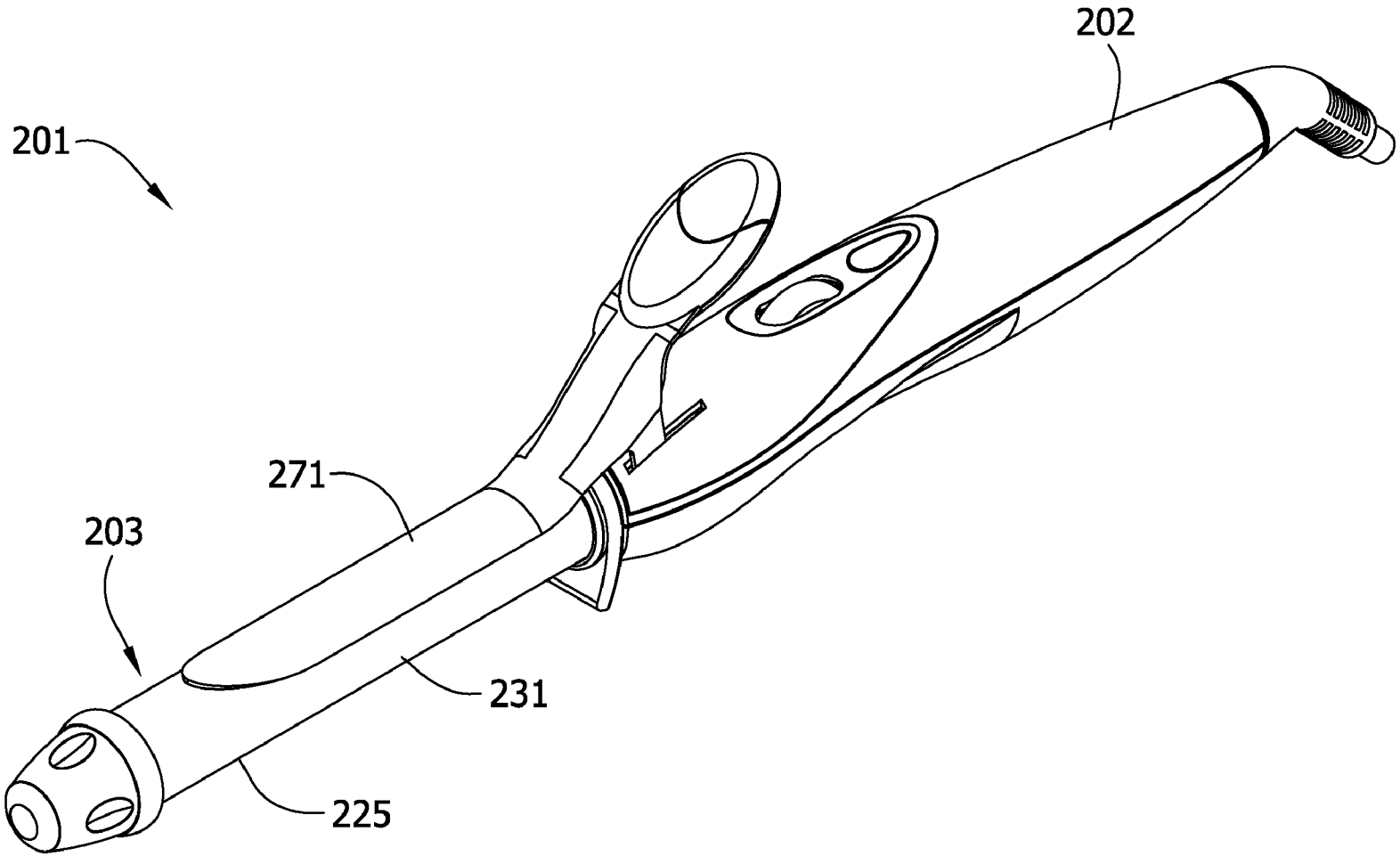
FIG. 16 is a perspective of a second embodiment of a hair styling apparatus according to the present invention in the form of a curling iron, with arms of the curling iron illustrated in a closed position of the curling iron.
Figure 17:
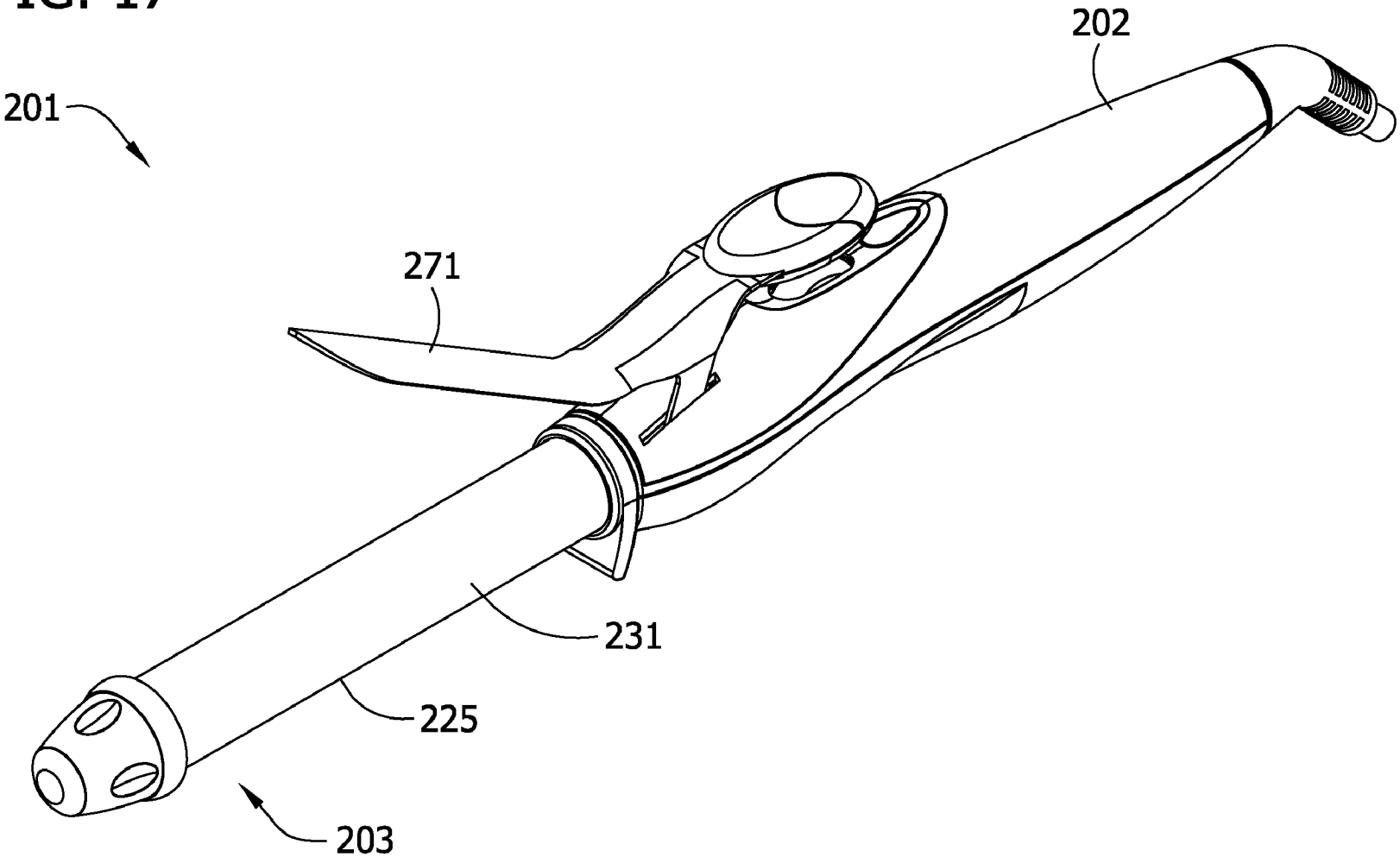
FIG. 17 is a perspective of the curling iron of FIG. 16 with the arms in an open position of the curling iron.
Figure 18:
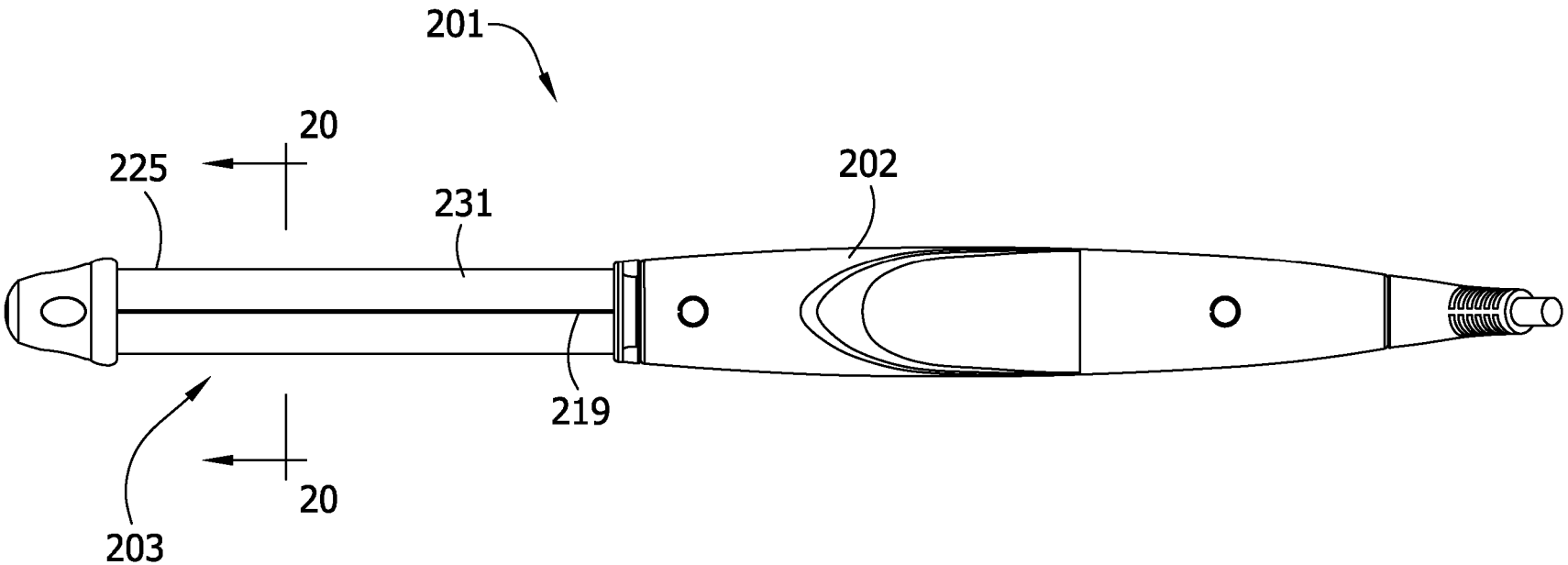
FIG. 18 is a bottom plan view of the curling iron of FIG. 16.

In the illustrated embodiment, the curling iron 201 further comprises a clamp 271 (broadly, a second arm) pivotally connected to the first arm 203, and in particular to the handle 202. The clamp 271 is pivotable relative to the first arm 203, i.e., relative to the heating member assembly 203 and handle 202 between an open position of the curling iron (FIG. 17) and a closed position thereof (FIG. 16). In the closed position, at least a portion of the clamp 271 is positioned in close proximity to the hair-facing surface 225 of the heating member assembly 203 (e.g., the cloth 231 covering the heating member 205) to hold hair between the clamp and the heating member assembly. The clamp 271 is sufficiently spaced from the heating member assembly 203 in the open position of the curling iron 201 so that the clamp and heating member assembly are generally inoperative to hold hair therebetween. A biasing member (not shown), such as a coil spring, biases the clamp 271 toward the closed position of the curling iron 201. It is understood, however, that the clamp 271 (i.e., the second arm) may be omitted without departing from the scope of this invention.

Although the drawings and above description illustrate and describe the hair styling apparatus in the form of a hair straightener 101 and curling iron 201, it is understood that the hair styling apparatus may comprise any hair styling apparatus other than those set forth herein and remain within the scope of this invention. In particular, any hair styling apparatus that has one or more heating members that would otherwise come into direct contact with hair during styling may be covered with a cloth in accordance with the present invention. The term "arm", as used herein is intended only to refer to a carrier of the heating member and is not intended to be limited to structure that is necessarily elongate or otherwise has a greatest dimension along its length.

It is also contemplated that the hair styling apparatus need not be a hand-held apparatus, i.e., held in the user's hands during use. For example, the hair styling apparatus may comprise a hair roller (not shown) having a cloth in accordance with the present invention covering the outer, hair facing surface of the heating member of the hair roller.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products and methods without departing from the scope of the invention, it is intended that all matter contained in the above description and shown in the accompanying drawings shall be interpreted as illustrative and not in a limiting sense.

What is claimed is:

1. A hair styling apparatus comprising:

first and second arms operatively secured to one another for movement toward and away from each other;

a heating member on the first arm, the heating member being adapted to apply heat to hair and having an outer hair-facing surface, an inner surface opposite the hair facing surface, and opposite side edges between the outer hair-facing surface and the inner surface;

a cloth constructed at least in part of a monofilament of a fluorinated polyethylene and covering at least a portion of the heating member to define a hair-facing surface onto which hair is placed in contact therewith for heating, wherein the cloth is unbonded to the heating member, and transverse portions of the cloth extend at least to the respective side edges of the heating member and are disposed between the respective side edges and the first arm.

2. The hair styling apparatus set forth in claim 1 wherein the cloth is constructed at least in part of a monofilament of a polytetrafluoroethylene.

3. The hair styling apparatus set forth in claim 1 wherein the cloth is constructed at least in part of a monofilament of a polytetrafluoroethylene derivative.

4. The hair styling apparatus set forth in claim 1 wherein the entire cloth is constructed of a monofilament polytetrafluoroethylene.

5. The hair styling apparatus set forth in claim 1 wherein the cloth is a woven cloth.

6. The hair styling apparatus set forth in claim 1 wherein the cloth is constructed at least in part of a yarn comprising a plurality of monofilaments of a polytetrafluoroethylene.

7. The hair styling apparatus set forth in claim 6 wherein the cloth is woven entirely of yarns, each yarn comprising a plurality of monofilaments of a polytetrafluoroethylene.

8. The hair styling apparatus set forth in claim 7 wherein the weave has a warp count of about 75 to about 78 per inch and a fill count of about 62 to about 69 per inch.

9. The hair styling apparatus set forth in claim 1 wherein the cloth is held taut over at least the outer hair-facing surface of the heating member and in assembly therewith to define the hair-facing surface of the heating member assembly.

10. The hair styling apparatus set forth in claim 1 wherein the cloth covers substantially an entirety of the outer hair-facing surface of the heating member, wraps around the opposite side edges, and covers at least a portion of the inner surface of the heating member.

11. The hair styling apparatus set forth in claim 10 wherein the cloth has transverse side margins disposed generally over the inner surface of the heating member in transversely spaced relationship with each other.

12. The hair styling apparatus set forth in claim 11 wherein at least one connector extends transversely between and interconnects the transverse side margins of the cloth to hold the cloth in assembly with the heating member.

13. The hair styling apparatus set forth in claim 12 wherein the at least one connector comprises at least one spring member extending transversely between and interconnecting the transverse side margins of the cloth.

14. The hair styling apparatus set forth in claim 1 wherein the apparatus comprises a hair straightener.

15. The hair styling apparatus set forth in claim 14 wherein the hair straightener damages less than or equal to about 40 percent of hair according to a Hair Damage Assessment Test at a temperature of at least about 150 degrees Celsius.

16. The hair styling apparatus set forth in claim 1 wherein the apparatus comprises a curling iron.

17. The hair styling apparatus set forth in claim 1 further comprising:

a second heating member on the second arm, the second heating member being adapted to apply heat to hair and having an outer hair-facing surface, an inner surface opposite the hair facing surface, and opposite side edges between the outer hair-facing surface and the inner surface; and a second cloth constructed at least in part of a monofilament of a fluorinated polyethylene and covering at least a portion of the second heating member to define a second hair-facing surface onto which hair is placed in contact therewith for heating, wherein the second cloth is unbonded to the second heating member, and portions of the second cloth generally adjacent to the side edges of the second heating member are sandwiched between the second heating member and the second arm.

18. The hair styling apparatus set forth in claim 1 wherein the first and second arms are movable toward one another to generally hold hair between the hair-facing surfaces of said first and second arms.

19. A hair styling apparatus comprising:

a heating member for applying heat to hair, the heating member having a hair-facing surface onto which hair is placed in contact therewith for heating of the hair;

a cloth covering at least a portion of the hair-facing surface of the heating member and having a longitudinal direction and a transverse direction, the cloth being responsive to heating of the heating member to shrink relative to said heating member in at least one of the longitudinal direction and the transverse direction of the cloth;

at least one connector coupling the cloth to the heating member, the at least one connector configured to elastically elongate to facilitate maintaining a tension of the cloth upon the heat-induced shrinkage of the cloth;

a first arm, at least a portion of the cloth covering the heating member defining a hair-facing surface of the first arm, the heating member being formed separate from and carried by the first arm, the heating member having an inner surface opposite the hair-facing surface; and a second arm having a hair-facing surface and being moveable relative to the first arm to configure the hair styling apparatus between a clamping position in which the first and second arms are positioned to generally clamp hair between the hair-facing surfaces of the first and second arms and an open position in which the first and second arms are spaced from each other such that the arms are inoperative to generally clamp hair between the hair-facing surfaces of said arms;

the cloth being unbonded to and held in assembly with the heating member, the cloth covering the hair-facing surface of the heating member and at least a portion of the inner surface of the heating member, the cloth having transverse side margins disposed generally over the inner surface of the heating member in transversely spaced relationship with each other;

the at least one connector extending transversely between and interconnecting the transverse side margins of the cloth to hold the cloth in assembly with the heating member, the at least one connector comprising at least one spring member extending transversely between and interconnecting the transverse side margins of the cloth.

20. The hair styling apparatus set forth in claim 19 wherein the cloth is responsive to heating of the heating member to shrink in said at least one direction in the range of about one percent to about eight percent.

21. The hair styling apparatus set forth in claim 19 wherein the cloth is a woven cloth.

22. The hair styling apparatus set forth in claim 19 wherein the cloth is held taut over the hair-facing surface of the heating member.

23. The hair styling apparatus set forth in claim 19 wherein the heating member associated with the first arm comprises a first heating member, the apparatus further comprising a second heating member having a hair facing surface and being carried by the second arm, and a second cloth covering the hair-facing surface of the second heating member and defining the hair-facing surface of the second arm, the second cloth having a longitudinal direction and a transverse direction, the second cloth being responsive to heating of the second heating member to shrink relative to said second heating member in at least one of the longitudinal direction and the transverse direction of the second cloth.

24. The hair styling apparatus set forth in claim 23 wherein the second cloth is unbonded to and held in assembly with the second heating member.

25. A hair styling apparatus comprising:

a heating member for applying heat to hair, the heating member having a hair-facing surface onto which hair is placed in contact therewith for heating of the hair;

a cloth covering at least a portion of the hair-facing surface of the heating member, the cloth being unbonded to the heating member and held in tension over said portion of the hair-facing surface of the heating member;

at least one connector coupling the cloth to the heating member, the at least one connector configured to elastically elongate to facilitate maintaining a tension of the cloth upon a heat-induced shrinkage of the cloth;

a first arm, said cloth covering at least the portion of the hair-facing surface of the heating member defining a hair-facing surface of the first arm;

a second arm having a hair-facing surface and being moveable relative to the first arm to configure the hair styling apparatus between a clamping position in which the first and second arms are positioned to generally clamp hair between the hair-facing surfaces of the first and second arms and an open position in which the first and second arms are spaced from each other such that the arms are inoperative to generally clamp hair between the hair-facing surfaces of said arms;

wherein the heating member is formed separate from and carried by the first arm, the heating member having an inner surface opposite its hair-facing surface, the cloth being unbonded to and held in assembly with the heating member with the cloth being held in tension over the hair-facing surface of the heating member;

wherein the cloth covers the hair-facing surface of the heating member and at least a portion of the inner surface of the heating member;

wherein the cloth has transverse side margins disposed generally over the inner surface of the heating member in transversely spaced relationship with each other.

26. The hair styling apparatus set forth in claim 25 wherein the cloth is a woven cloth.

27. The hair styling apparatus set forth in claim 25 wherein the at least one connector extends transversely between and interconnects the transverse side margins of the cloth to hold the cloth in assembly with the heating member.

28. The hair styling apparatus set forth in claim 27 wherein the at least one connector comprises at least one spring member extending transversely between and interconnecting the transverse side margins of the cloth.

* * * * *